US012253096B2

(12) United States Patent
Kollipara et al.

(10) Patent No.: US 12,253,096 B2
(45) Date of Patent: Mar. 18, 2025

(54) FAN ASSEMBLY

(71) Applicant: Greenheck Fan Corporation, Schofield, MN (US)

(72) Inventors: Vijaya K. Kollipara, Weston, WI (US); Thomas Frank, Scholfield, WI (US); Shamus Doran, Kronenwetter, WI (US); Shawn Michael Koeppel, Kronenwetter, WI (US)

(73) Assignee: Greenheck Fan Corporation, Schofield, WI (US)

( * ) Notice: Subject to any disclaimer, the term of this patent is extended or adjusted under 35 U.S.C. 154(b) by 0 days.

(21) Appl. No.: 18/222,088

(22) Filed: Jul. 14, 2023

(65) Prior Publication Data

US 2024/0018970 A1 Jan. 18, 2024

Related U.S. Application Data

(60) Provisional application No. 63/526,556, filed on Jul. 13, 2023, provisional application No. 63/491,243, filed on Mar. 20, 2023, provisional application No. 63/488,434, filed on Mar. 3, 2023, provisional application No. 63/477,319, filed on Dec. 27, 2022, (Continued)

(51) Int. Cl.
*F04D 29/42* (2006.01)
*F04D 25/08* (2006.01)

(52) U.S. Cl.
CPC ..... *F04D 29/4246* (2013.01); *F04D 25/08* (2013.01)

(58) Field of Classification Search
CPC ..... F04D 29/4246; F04D 29/4226; F05D 2250/52
See application file for complete search history.

(56) References Cited

U.S. PATENT DOCUMENTS 3,759,627 A * 9/1973 Ehlinger ..... F04D 29/441 415/207
4,890,547 A 1/1990 Wagner et al.
(Continued)

FOREIGN PATENT DOCUMENTS

CN 202266503 U * 6/2012
CN 204419703 U 6/2015
(Continued)

OTHER PUBLICATIONS

International Search Report and Written Opinion from PCT/US2023/070260 mailed Nov. 6, 2023, 41 pages.

*Primary Examiner* — Justin D Seabe
(74) *Attorney, Agent, or Firm* — Merchant & Gould P.C.

(57) ABSTRACT

A fan assembly configured to address expansion losses and associated noises in centrifugal fans modifies the blades and housing to enhance the efficiency of air flow. The fan assembly can include a centrifugal fan wheel and shaped housing incorporating curved walls that guide the airflow along an efficient path, minimizing abrupt directional changes and resulting in improved energy efficiency and reduced noise levels compared to conventional housed centrifugal fans. Additionally, fan assembly includes a low-profile, energy-efficient motor positioned within an interior region defined by the centrifugal fan wheel, reducing the overall size of the fan assembly. In embodiments, the fan assemblies can function as standalone fans or be arranged in an array configuration to effectively move large volumes of air.

26 Claims, 25 Drawing Sheets

Related U.S. Application Data provisional application No. 63/389,716, filed on Jul. 15, 2022.

(56) References Cited

U.S. PATENT DOCUMENTS

| | | | | |
|---|---|---|---|---|
| 8,142,147 | B2 | 3/2012 | O'Connor et al. | |
| 10,316,860 | B2 * | 6/2019 | Fujimoto | F04D 29/162 |
| 10,393,123 | B2 * | 8/2019 | Gundel | F04D 29/441 |
| 2021/0262487 | A1 | 8/2021 | Loercher et al. | |

FOREIGN PATENT DOCUMENTS

| | | | | |
|---|---|---|---|---|
| CN | 105201912 | A | 12/2015 | |
| CN | 110206767 | A | 9/2019 | |
| CN | 210769539 | U | 6/2020 | |
| CN | 111648981 | A | 9/2020 | |
| DE | 202004019691 | U1 * | 5/2006 | F04D 29/4246 |
| EP | 3348840 | A1 | 7/2018 | |
| EP | 3184826 | B1 | 4/2020 | |
| GB | 1512294 | A | 6/1978 | |
| WO | 2021143971 | A1 | 7/2021 | |

* cited by examiner

FAN ASSEMBLY

CROSS-REFERENCE TO RELATED APPLICATIONS

This application claims the benefit of U.S. Provisional Application Nos. 63/389,716, filed Jul. 15, 2022; 63/477,319, filed Dec. 27, 2022; 63/488,434, filed Mar. 3, 2023; 63/491,243, filed Mar. 20, 2023; and 63/526,556, filed Jul. 13, 2023, the disclosures of which are hereby incorporated herein by reference.

TECHNICAL FIELD

The present disclosure relates generally to fans used in air handling and air delivery equipment for heating, ventilation and air conditioning systems.

BACKGROUND

Centrifugal fans, including plenum fans and housed centrifugal fans, are commonly utilized in Heating, Ventilation, and Air Conditioning (HVAC) systems. Plenum fans are specifically designed for use within plenum chambers or enclosed spaces and ductwork where air circulates, while housed centrifugal fans have a potentially broader range of applications within ventilation systems. Despite their specific applications, both types of fans face common issues regarding efficiency and noise generation.

Regarding static efficiency, the expansion losses at fan outlet of centrifugal fans is significantly higher compared to frictional losses attributed to air resistance caused by friction and turbulence as the air flows through the fan. The resistance intensifies with increasing air velocities, reaching its peak at the point of maximum velocity. Consequently, the high air velocity at the fan discharge leads to significant expansion losses as the air enters the larger cross-sectional area of the plenum, resulting in a drop in air pressure and velocity, negatively impacting the fan's efficiency and overall performance. Typically, a centrifugal fan with an static efficiency rating of about 70-75% is deemed acceptable.

In addition to efficiency concerns, noise generation is another issue associated with centrifugal fans. The radial acceleration of air in these fans can result in the production of noise, which can be disruptive and undesirable in various applications.

Although efforts have been made to address these issues, further advancements to enhance the fan static efficiency and acoustic characteristics of centrifugal fans are desired.

SUMMARY

Embodiments of the present disclosure address the ongoing issue of expansion losses and associated noises in centrifugal fans by modifying the blade shape profile and housing to enhance the efficiency of air flow. Specifically, the outlet edge of the blades can be adjusted to create multiple air channels (e.g., gaps between blades) that progressively increase in cross-sectional area from the central air inlet aperture to the air outlet edge, which serves to reduce the velocity of the air or fluid passing through the channels, resulting in increased pressure, and mitigating the efficiency losses typically observed in conventional plenum fans and un-housed centrifugal fans.

Moreover, the housing can incorporate shaped walls that guide the flow of air through the fan along an efficient route, minimizing abrupt directional changes through shallow angles and curves that extend in multiple planes, leading to improved energy efficiency and reduced noise levels, particularly in comparison to conventional housed centrifugal fans of the prior art. Additionally, the disclosed fan assemblies feature a low-profile, energy-efficient motor positioned within an interior region defined by the centrifugal fan. This arrangement reduces the overall size of the fan assembly, making it more compact and space-saving.

In certain implementations, the fan assembly can serve as a standalone fan, replacing traditional plenum or housed centrifugal fans. In other implementations, multiple fan assemblies can be arranged in an array configuration, working together to move large volumes of air. For instance, a single large air mover in an HVAC or cooling system can be substituted with a more energy-efficient array of fan assemblies. This replacement not only reduces operational noise but also minimizes the physical footprint of the air mover due to the compact and lightweight design of the fan assemblies.

One aspect of the present disclosure provides a housing for a fan assembly, the housing including a first end wall, a second end wall defining a central opening, a plurality of sidewalls extending between the first and second end walls, each of the plurality of sidewalls defining a main portion and a transition portion deviating radially from the main portion, and a plurality of openings located adjacent the transition portions and extending at least partially between the first and second end walls.

In one aspect, the plurality of openings includes three to five openings. In one aspect, the plurality of openings includes four openings. In one aspect, the plurality of sidewalls are identical to each other. In one aspect, the transition portions are curved. In one aspect, the transition portions are curved in a concave direction with respect to a longitudinal axis of the housing. In one aspect, the transition portions are curved with a first curved portion and a second curved portion, wherein the first curved portion is curved in a concave direction with respect to a longitudinal axis of the housing and the second curved portion is curved in a convex direction with respect to the longitudinal axis.

In one aspect, the plurality of openings are non-coplanar with the main portions of the plurality of the sidewalls. In one aspect, the first end wall has a curvature in a direction away from the second end wall and along the longitudinal axis. In one aspect, the first end wall and the second end wall each have a curvature oriented axially in the same direction along the longitudinal axis.

Another aspect of the present disclosure provides a fan assembly including a fan wheel, and a housing defining an interior cavity housing the fan wheel, the housing including a first end wall, a second end wall defining a central opening, a plurality of sidewalls extending between the first and second end walls, each of the plurality of sidewalls defining a main portion and a transition portion deviating radially from the main portion, and a plurality of openings located adjacent the transition portions and extending at least partially between the first and second end walls.

In one aspect, the plurality of openings includes three to five openings. In one aspect, the plurality of openings includes four openings. In one aspect, the plurality of sidewalls are identical to each other. In one aspect, the transition portions are curved. In one aspect, the transition portions are curved in a concave direction with respect to a longitudinal axis of the housing. In one aspect, the transition portions are curved with a first curved portion and a second curved portion, wherein the first curved portion is curved in a concave direction with respect to a longitudinal axis of the housing and the second curved portion is curved in a convex direction with respect to the longitudinal axis. In one aspect, the plurality of openings are non-coplanar with the main portions of the plurality of the sidewalls. In one aspect, the first end wall of the housing has a curvature in a direction opposite the second end wall and along the longitudinal axis. In one aspect, the first end wall and the second end wall of the housing each have a curvature oriented in the same direction along the longitudinal axis.

Another aspect of the present disclosure provides a fan array including a plurality of fan assemblies arranged in an array, each of the plurality of fan assemblies including a fan wheel and a housing defining an interior cavity housing the fan wheel, the housing including a first end wall, a second end wall defining a central opening, a plurality of sidewalls extending between the first and second end walls, and a plurality of openings extending at least partially between the first and second end walls.

In one aspect, the fan assemblies are oriented such that, for each opening, a tangent line extending from an outer diameter of the fan wheel and through the opening does not intersect with the housing of any other fan assembly in the fan array. In one aspect, at least some of the fan assemblies are located in an axially offset position relative to other of the plurality of fan assemblies. In one aspect, the plurality of openings includes three to five openings. In one aspect, the first end wall of the housing has a curvature in a direction opposite the second end wall and along the longitudinal axis. In one aspect, the first end wall and the second end wall of the housing each have a curvature oriented in the same direction along the longitudinal axis. In one aspect, the plurality of fan assemblies include at least two fan assemblies with different housings. In one aspect, at least one of the different housings includes at least one of a curved first end wall and a curved second end wall.

Yet another aspect of the present disclosure provides a fan-motor assembly including a fan wheel extending along a vertical axis and defining a first axial length, the fan wheel including a plurality of fan blades extending between an annular inlet structure and a base structure, and an electronically commutated motor extending along the vertical axis and including a housing defining a second axial length, the electronically commutated motor further including a printed circuit board stator and a rotor operably coupled to the base structure, wherein the fan-motor assembly has a total axial length that is less than the sum of the first and second axial lengths.

In one aspect, the base structure defines an interior region having an axial length extending along the vertical axis. In one aspect, at least a portion of the electronically commutated motor housing is disposed within the base structure interior region. In one aspect, the fan-motor assembly further includes a spacer block coupled to the rotor of the electric motor and coupled to the fan wheel base structure. In one aspect, the spacer block is disposed within the base structure interior region. In one aspect, the fan wheel is a centrifugal fan wheel. In one aspect, the fan motor assembly further includes a housing or other frame supporting the housing of the electric motor. In one aspect, the fan wheel further includes a front wall assembly including a planar portion and an inlet portion coaxially aligned with the fan wheel annular inlet structure. In one aspect, the front wall assembly is supported by a frame assembly supporting the motor housing. In one aspect, the present disclosure provides a plurality of fan motor assemblies arranged in an array comprising at least one column and/or one row of distinct fan motor assemblies.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the embodiments disclosed herein are based.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Figure 1:
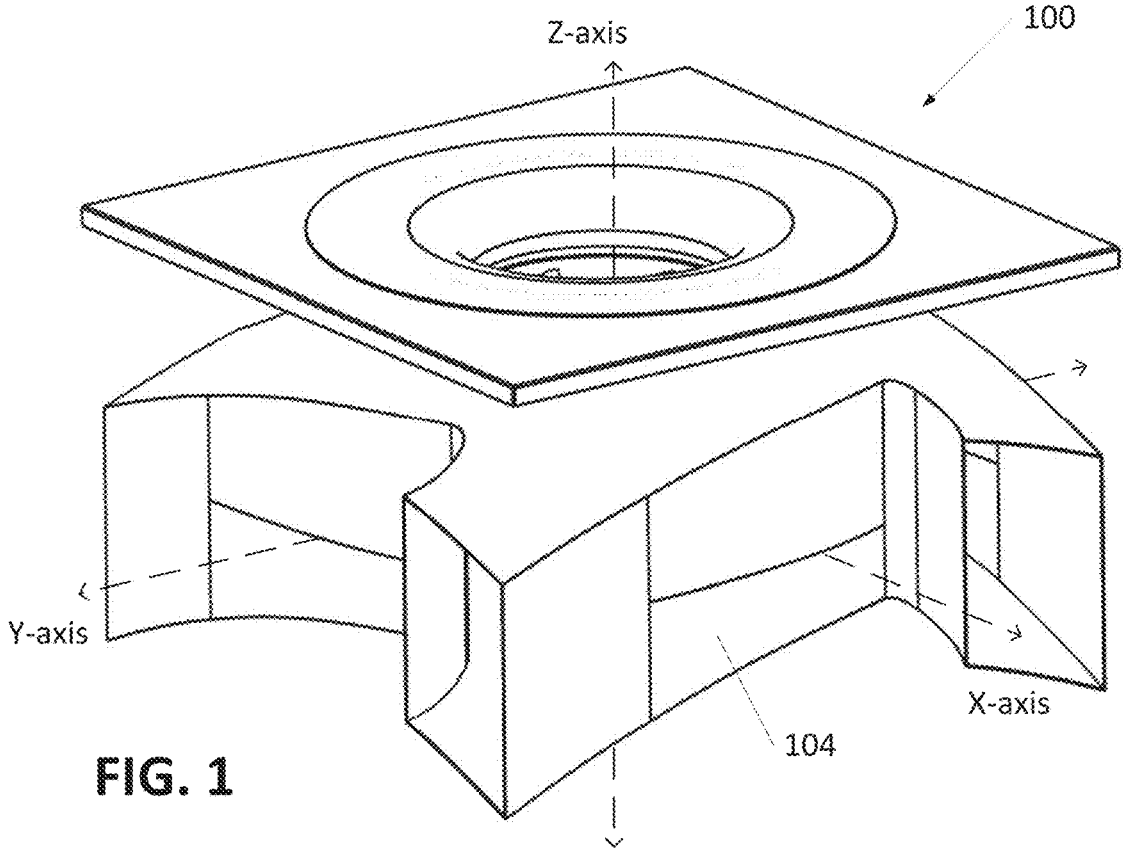
FIG. 1 is a top perspective view depicting a fan assembly, in accordance with an embodiment of the disclosure.
Figure 2:
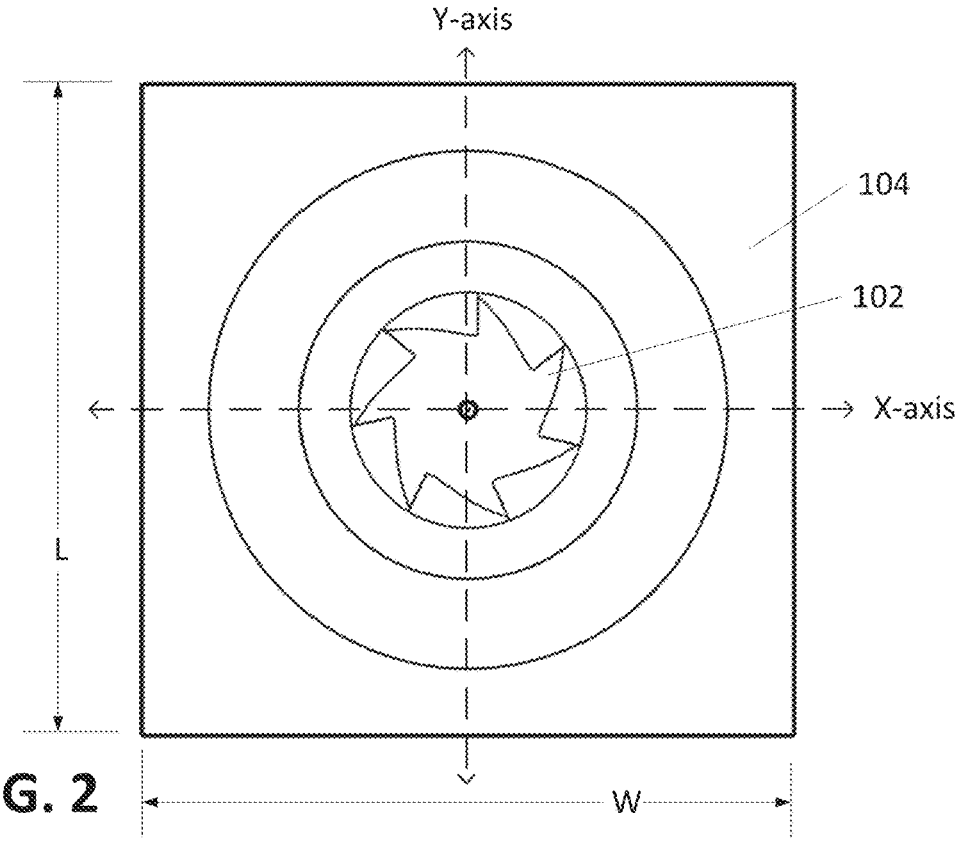
FIG. 2 is a top plan view of the fan assembly of FIG. 1, in accordance with an embodiment of the disclosure.
Figure 3:
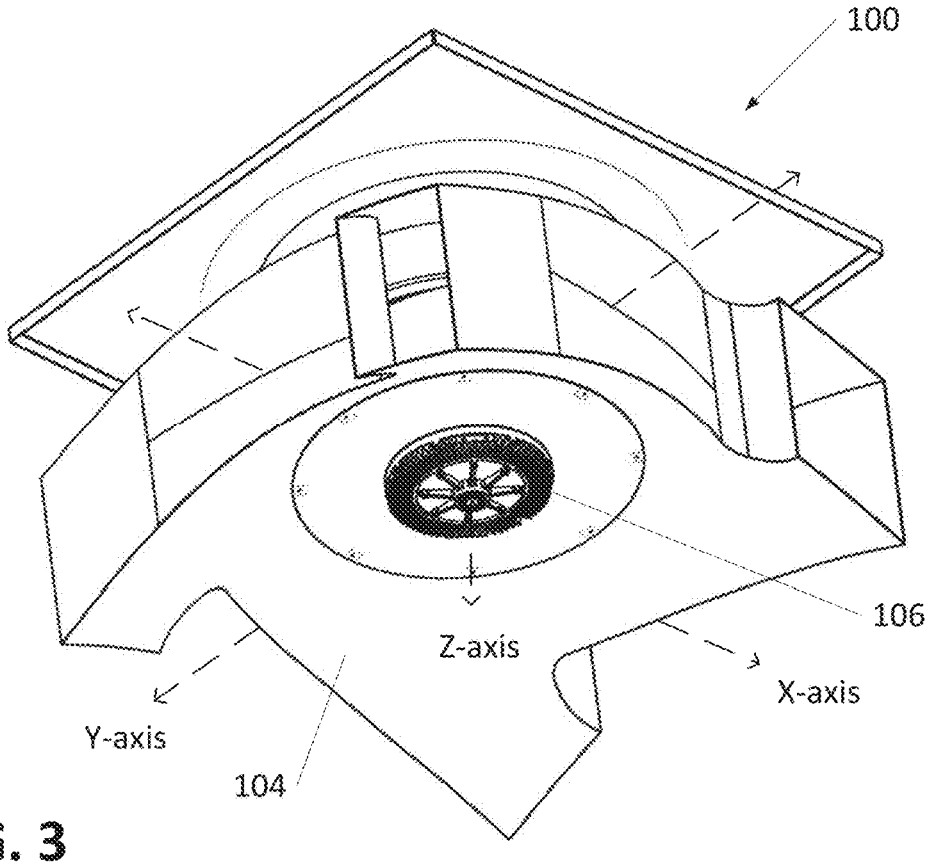
FIG. 3 is a bottom perspective view depicting the fan assembly of FIG. 1, in accordance with an embodiment of the disclosure.
Figure 4:
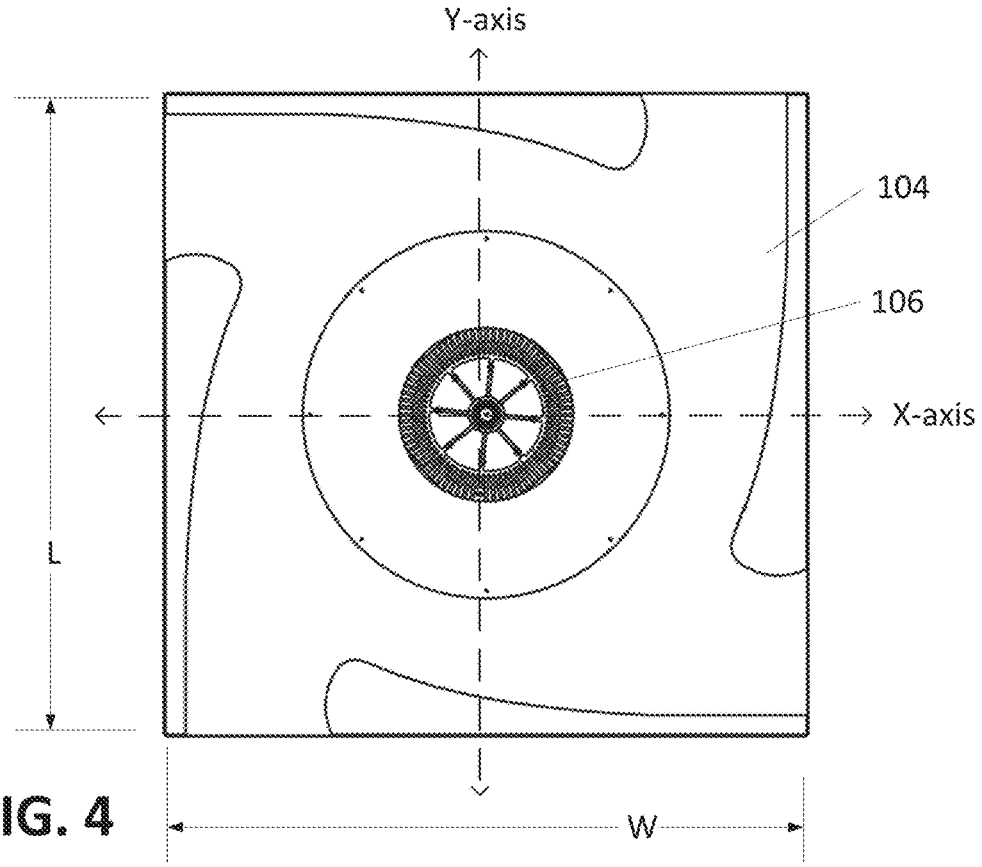
FIG. 4 is a bottom plan view of the fan assembly of FIG. 1, in accordance with an embodiment of the disclosure.
Figure 5:
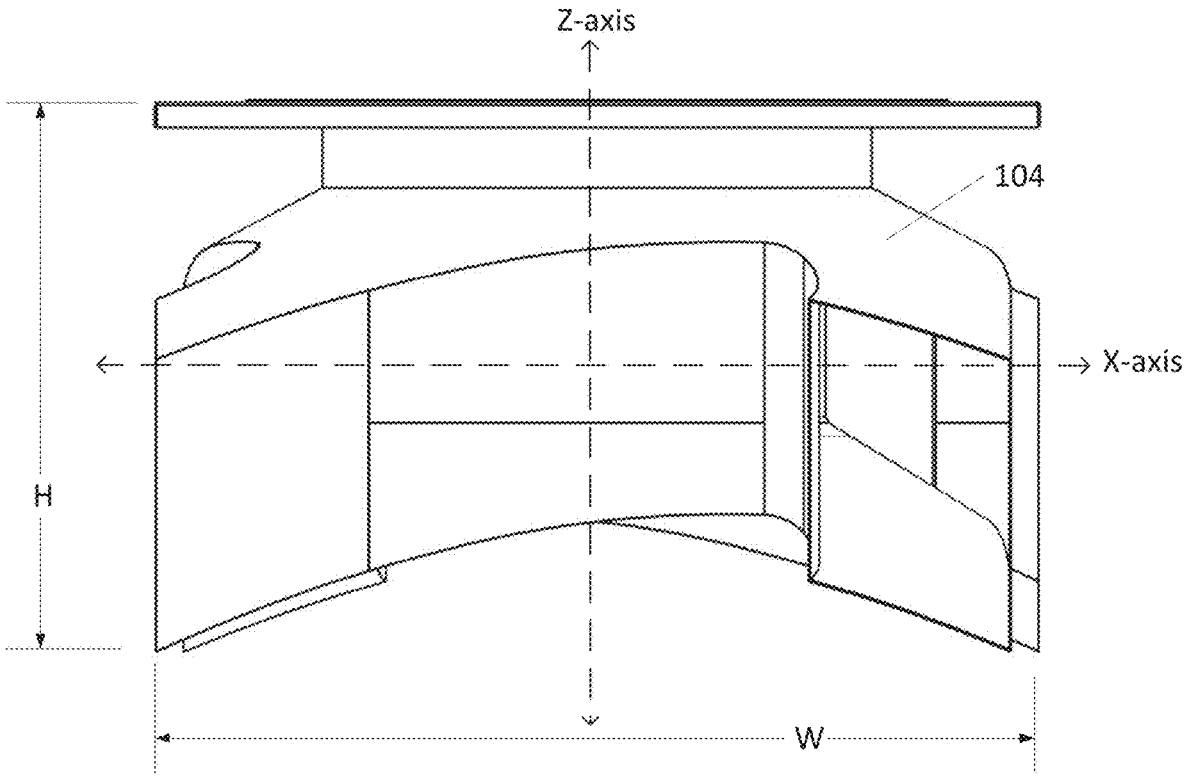
FIG. 5 is a profile view of the fan assembly of FIG. 1, in accordance with embodiments of the disclosure.
Figure 6:
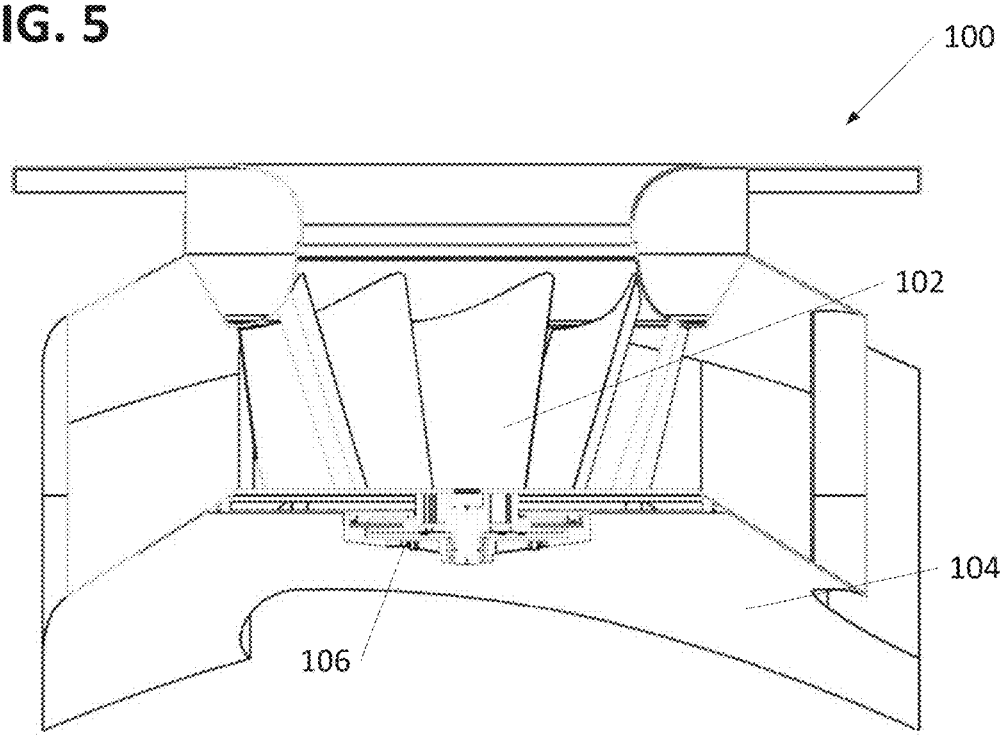
FIG. 6 is a cross-sectional, profile view of the fan assembly of FIG. 5, in accordance with an embodiment of the disclosure.

Reference will now be made in detail to exemplary aspects of the present disclosure that are illustrated in the accompanying drawings. Wherever possible, the same reference numbers will be used throughout the drawings to refer to the same or like parts.

Referring to FIGS. 1-6, a fan assembly 100 is depicted in accordance with an embodiment of the disclosure. The fan assembly 100 can be used to transport air relating to building heating, ventilation, and air conditioning (HVAC) systems. In some embodiments, and as described in more detail in a later portion herein, multiples of the fan assembly 100 can be used in a fan array arrangement. In some examples, the fan array arrangement can be a retrofit arrangement used to replace a larger fan in an existing air handling unit.

As depicted, the fan assembly 100 can include a centrifugal fan 102 disposed within a housing 104. The centrifugal fan 102 can include a plurality of blades, such that when the centrifugal fan 102 is rotated relative to the housing 104 the blades generate an airflow that enters the housing in an axial direction through a central opening located in a front of the housing, and is discharged in a radial direction towards one or more side walls of the housing. In other embodiments, the fan assembly 100 can employ other fan wheel configurations, such as mixed flow fan wheels, etc. An electric motor 106 can provide the power for rotating the centrifugal fan 102.

As depicted, the fan assembly 100 can span a width (W) along a lateral x-axis, a length (L) along a longitudinal y-axis, and a height or depth (D) along a vertical z-axis, wherein the lateral x-axis, longitudinal y-axis and vertical z-axis are orthogonal to one another, collectively forming a three dimensional coordinate system.

Embodiments of the present disclosure offer several advantages by incorporating a unique three-dimensional centrifugal fan 102 and housing 104 design for a more efficient airflow through the fan assembly 100, resulting in a fan assembly 100 both more energy-efficient and operates with reduced noise levels, particularly when compared to conventional housed centrifugal fans of the prior art. Additionally, the disclosed fan assemblies 100 feature a low-profile, energy-efficient motor 106 positioned within an interior region defined by the centrifugal fan 102, which effectively reduces the overall size of the fan assembly 100, making it more compact and space-saving.

In certain implementations, the fan assembly 100 can serve as a standalone fan, for example, in place of a traditional plenum or housed centrifugal fan. In other implementations, multiple fan assemblies 100 can be arranged in an array configuration, working collectively to move large volumes of air. For instance, as will be described in greater detail, a single large air mover in an existing HVAC or cooling system can be replaced with a more energy efficient array of fan assemblies 100, serving to both reduce the noise associated with operation, as well as to reduce the physical footprint of the air mover with a more compact, lighter weight design.

With additional reference to FIGS. 7-13, additional views of a centrifugal fan 102 are depicted in accordance with an embodiment of the disclosure. As depicted, the centrifugal fan 102 can include a wheel cone 108, a wheel back 110 and a plurality of blades 112. In some embodiments, an inlet cone 109 (e.g., forming a bell inlet structure) can be operably coupled to the wheel cone 108; although in some embodiments, at least a portion of the housing 104 can form a portion of the inlet extension.

Figure 9:
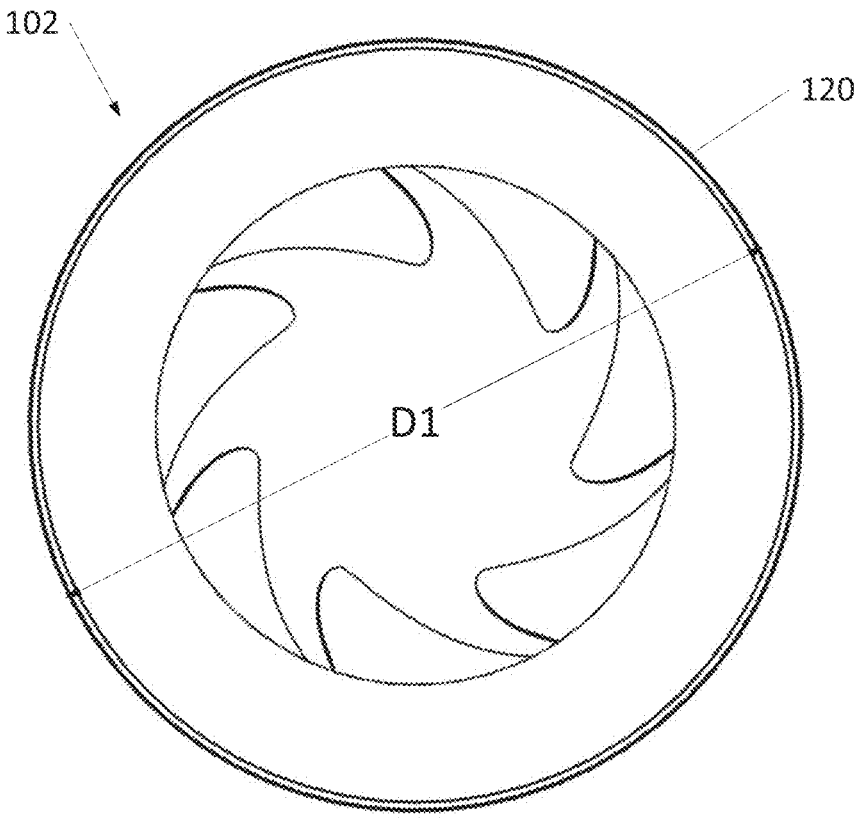
FIG. 9 is a top plan view of the centrifugal fan of FIG. 7, in accordance with an embodiment of the disclosure.
Figure 10:
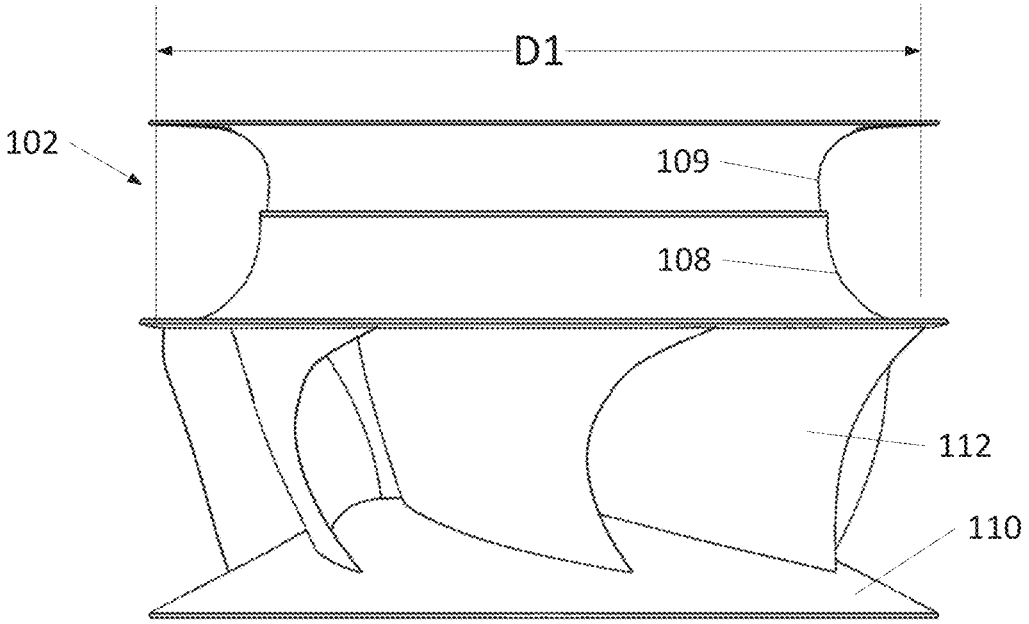
FIG. 10 is a profile view of the centrifugal fan of FIG. 7, in accordance with an embodiment of the disclosure.

In embodiments, the wheel cone 108 can include a first airflow surface 114, which can be in the form of a major surface representing one side of the wheel cone 108. In embodiments, the first airflow surface 114 can define the interior of a cone or bell structure. For example, in some embodiments, the first airflow surface 114 can generally have the shape of a curved funnel-shaped conical surface extending between a central air inlet aperture 116 and an air outlet or trailing edge positioned along an outer perimeter 120 of the wheel cone 108. The outer perimeter 120 can be defined by a diameter D1 (as depicted in FIGS. 9-10).

Figure 7:
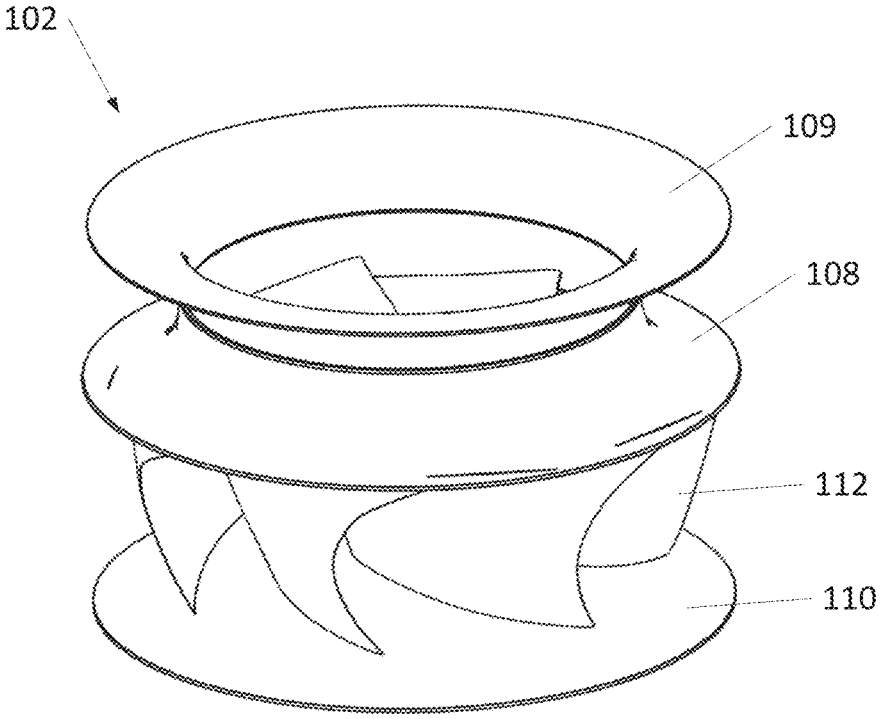
FIG. 7 is a perspective view of a centrifugal fan, in accordance with an embodiment of the disclosure.
Figure 8:
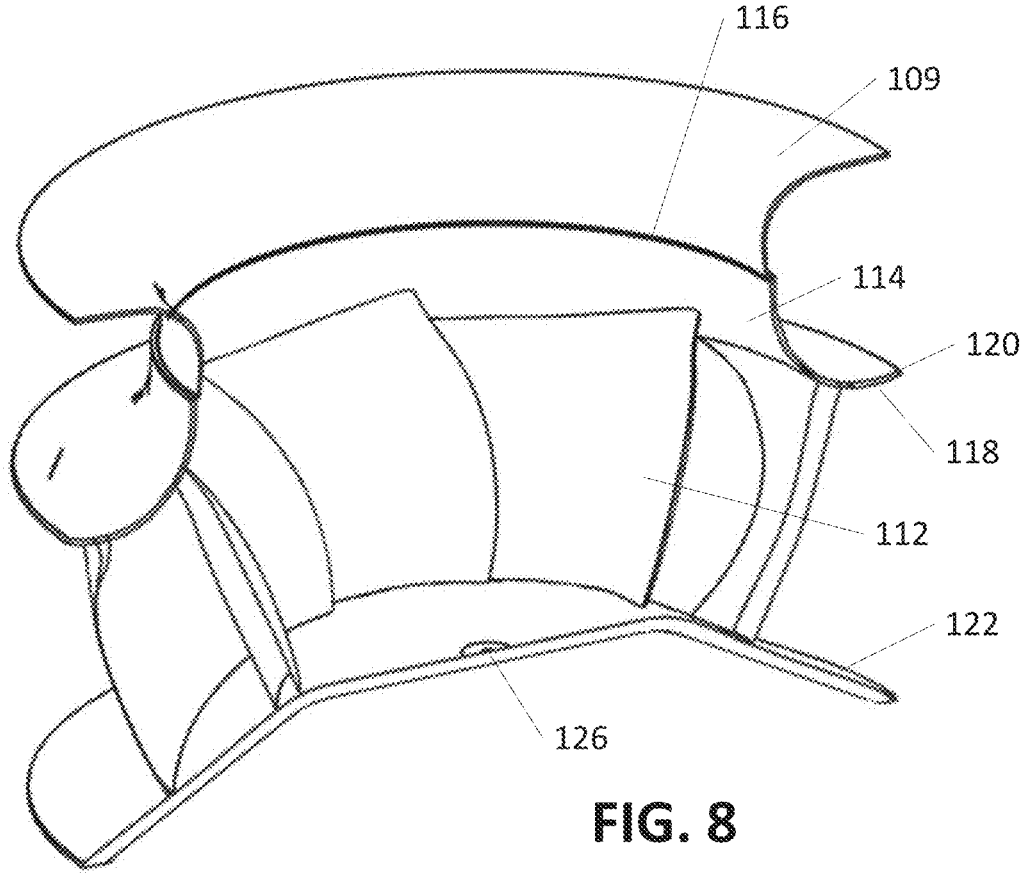
FIG. 8 is a cross-sectional, perspective view of the centrifugal fan of FIG. 7, in accordance with an embodiment of the disclosure.

With continued reference to FIGS. 7-8, the wheel back 110 can define a second airflow surface 122, which can be in the form of a major surface representing one side of the wheel back 110. In some embodiments, the second airflow surface 122 can be conical or frusto-conical in shape, such that the second airflow surface 122 represents an outside of a cone, in which an axis of the cone extends along the z-axis. For example, in some embodiments, the second airflow surface 122 can form an angle of between about 0° and about 60° with either of the x- or y-axes. In another embodiment, the second airflow surface 122 can have a curved or truncated dome-shaped profile. In such embodiments, the first airflow surface 114 and the second airflow surface 122 can serve to reduce the abrupt change in direction otherwise required of airflow entering into the centrifugal fan 102, thereby reducing turbulence tending to occur near a center 126 of the wheel back 110. In other embodiments, the second airflow surface can be substantially planar (e.g., depicted in FIG. 6).

Figure 11:
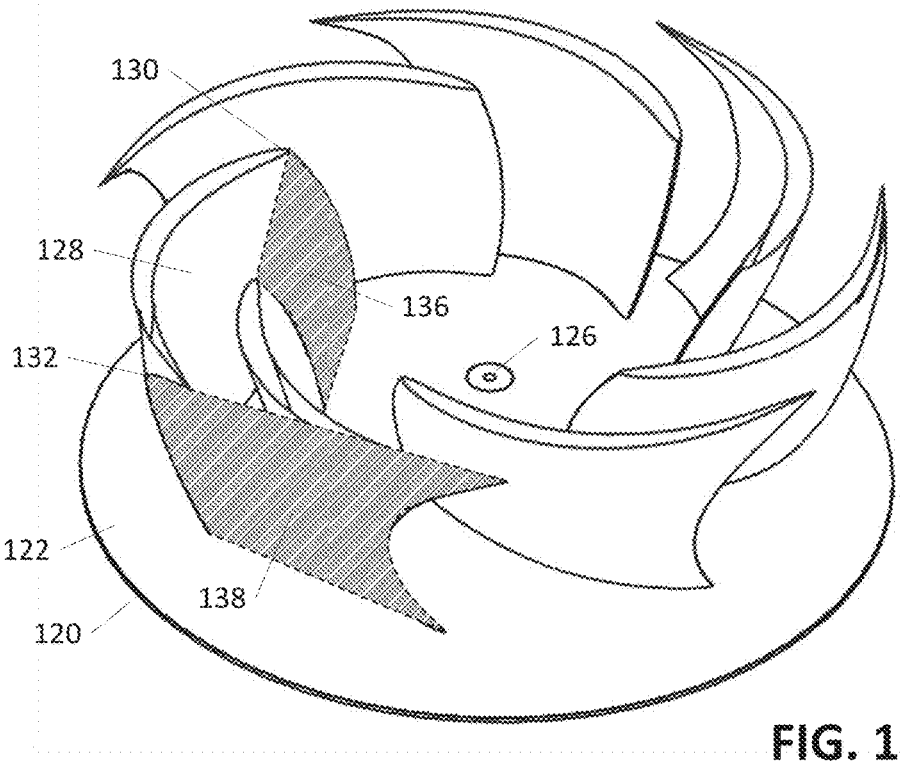
FIG. 11 is a cross-sectional, perspective view of the centrifugal fan of FIG. 7, in accordance with an embodiment of the disclosure.

In some embodiments, the plurality of blades 112 can operably couple the wheel cone 108 to the wheel back 110, such that the wheel cone 108 is spaced apart from the wheel back 110. In embodiments, a corresponding plurality of air channels 128 can be defined between the plurality of blades 112 (as depicted in FIG. 11). For example, the first airflow surface 114, the second airflow surface 122, and a series of adjacent blades 112 can cooperate to define a plurality of air channels 128.

In embodiments, each of the blades 112 can include an inlet or leading edge 130 positioned in proximity to the central air inlet aperture 116, and an outlet or trailing edge 132 positioned in proximity to the outer perimeter 120. A first area 136 defined by each air channel 128 in proximity to the leading edge 130 can have a smaller cross-sectional area than a second area 138 defined by the air channels 128 in proximity to the outer perimeter 120.

Such a configuration allows for a gradual increase in cross-sectional area as the air channels 128 progress towards the outer edge of the blades. By reducing the cross-sectional area at the leading edge (e.g., first area 136) and gradually increasing it towards the outer perimeter (e.g., second area 138), the velocity of the air passing through the air channels 128 is gradually reduced, resulting in increased pressure and mitigating the efficiency losses typically associated with centrifugal fans. Modification of the cross-sectional areas in this manner serves to improve the overall efficiency and performance of the fan assembly 100, while also minimizing noise generation.

Figure 12:
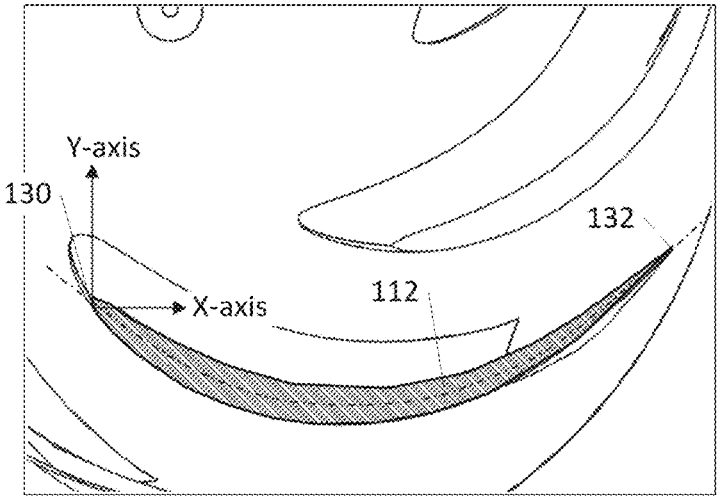
FIG. 12 is a cross-sectional view of a blade defined by the centrifugal fan of FIG. 7 along a plane parallel to the x- and y-axes, in accordance with an embodiment of the disclosure.
Figure 13:
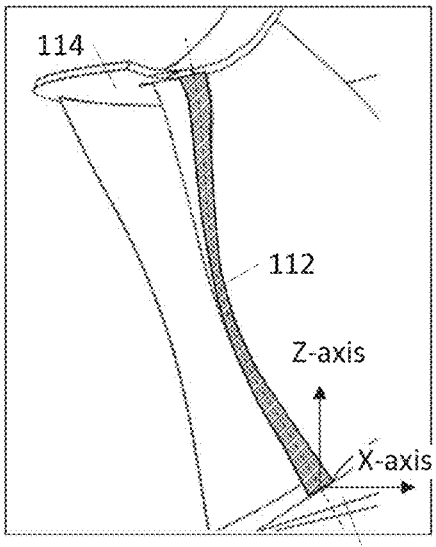
FIG. 13 is a cross-sectional view of a blade defined by the centrifugal fan of FIG. 7 along a plane parallel to the x- and z-axes, in accordance with an embodiment of the disclosure.
Figure 14:
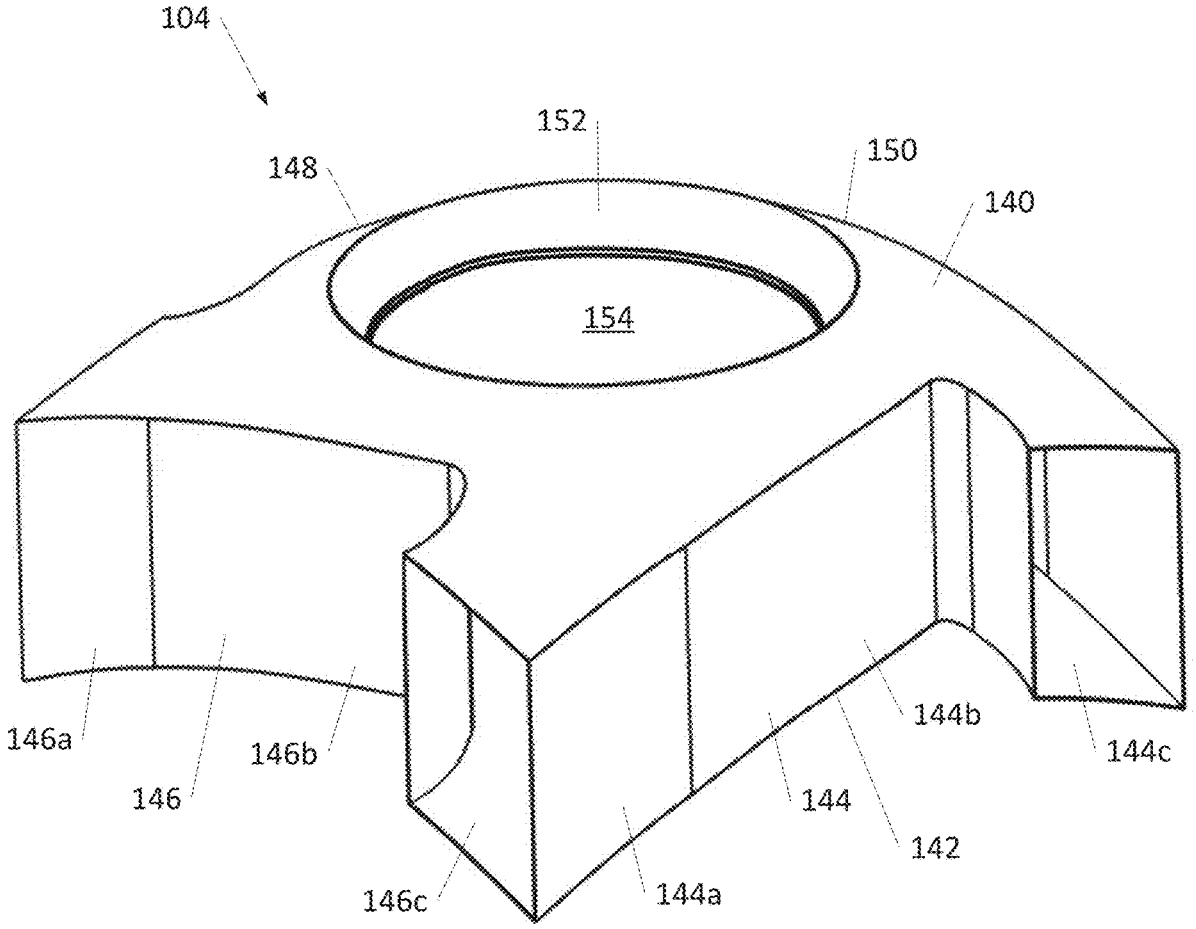
FIG. 14 is a perspective view depicting a fan assembly housing, in accordance with an embodiment of the disclosure.

As depicted in FIGS. 12-13, each of the blades 112 can have a complex three dimensional shape, exhibiting curves in a first plane parallel to the x- and y-axes (as depicted in FIG. 12), as well as in a second plane parallel to the x- and z-axes (as depicted in FIG. 13). Specifically, in some embodiments the trailing edge 132 of each blade 112 can be curved to increase the cross-sectional area of the second area 138 in proximity to the outer perimeter 120. In the example shown, the trailing edge 132 is provided with a concave asymmetric curved shape, which can generally serve to reduce expansion losses. Testing has shown that in some implementations, the asymmetrical trailing edge 132 curvature aids in the separation of flow at the wheel back 110 and the uniform distribution of pressure across the blade span (e.g., from the wheel cone 108 to the wheel back 110), resulting in a quieter, more energy efficient flow of air through the centrifugal fan 102.

In other embodiments, the centrifugal fan can employ additive manufacturing techniques such as 3D metal printing, enabling the fabrication of the centrifugal fan 102 without the need for a mold. For example, in one embodiment, fabrication can employ a fused Pellet Fabrication (FPF) process, which can involve feeding a mixture of metal powder and binder materials into a printing nozzle system via a pellet hopper. Thereafter, the printing nozzle can produce a three-dimensional "green" object, which can then undergo a debinding step. The debinding step can utilize a catalytic method involving nitric acid and the CataMIM® debinding method. Nitrogen gas can be employed to prevent oxidation of the metal during this step. Thereafter, the fabrication process can involve a sintering step to remove the binders to obtain a solid metal component with properties similar to wrought materials. Following the debinding process, the material may exhibit porosity in the range of 16% to 17%, which can be reduced to 1% to 2% by a subsequent sintering step to remove the binders to obtain a solid metal component with properties similar to wrought materials, and therefore may be stronger than an equivalent cast component. In some embodiments, additional post-processing steps, such as sanding or polishing, may be performed after sintering.

With additional reference to FIGS. 14-17, the housing 104 can have first end (e.g., front) wall 140 and a second end (e.g., rear) wall 142 between which sidewalls 144, 146, 148, and 150 extend. The first end wall 140 is shown as defining an opening 152 such that the fan assembly 100 can draw air into an interior volume 154 of the housing 104. In the example shown, the opening 152 generally forms a bell inlet structure shaped and sized to receive a portion of the wheel cone 108 or inlet cone 109 of the centrifugal fan 102.

Each of the sidewalls 144, 146, 148, and 150 can define a main portion 144*a*, 146*a*, 148*a*, and 150*a*, a transition portion 144*b*, 146*b*, 148*b*, and 150*b*, and an outlet opening 144*c*, 146*c*, 148*c*, and 150*c*. In one aspect, the main portions 144*a*, 146*a*, 148*a*, and 150*a* are shown as being generally straight or planar while the transition portions 144*b*, 146*b*, 148*b*, and 150*b* are provided with a curved or angular surface extending between the main portions 144*a*, 146*a*, 148*a*, and 150*a* and the openings 144*c*, 146*c*, 148*c*, and 150*c*. The housing 104 can be formed from various materials. For example, the housing 104 can be formed from a metal material, such as sheet metal and; although the use of other materials, is also contemplated.

Figure 15:
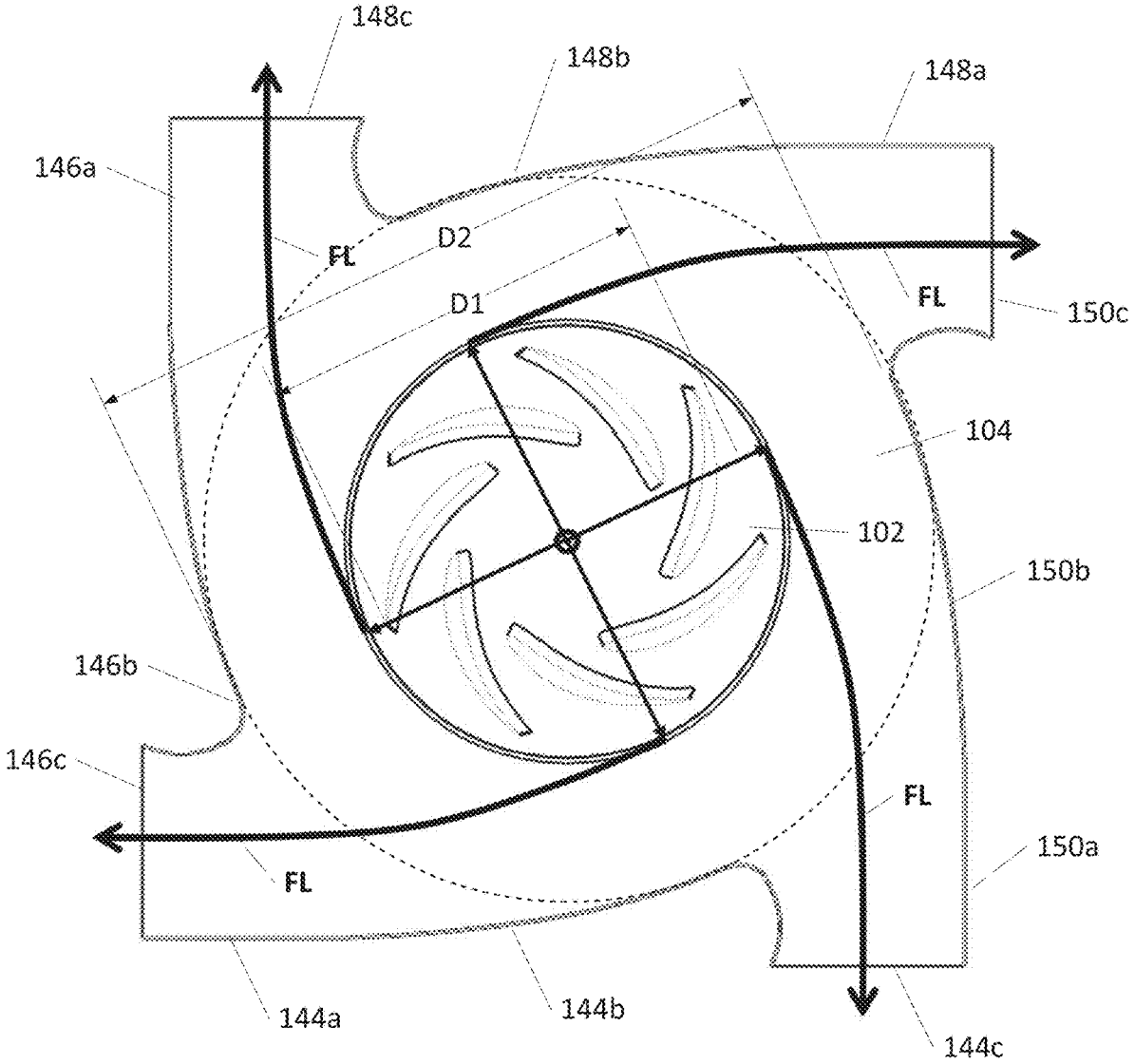
FIG. 15 is a top plan view depicting the fan assembly housing of FIG. 14 including flowlines depicting a general flow of air through the fan assembly housing, in accordance with an embodiment of the disclosure.
Figure 16:
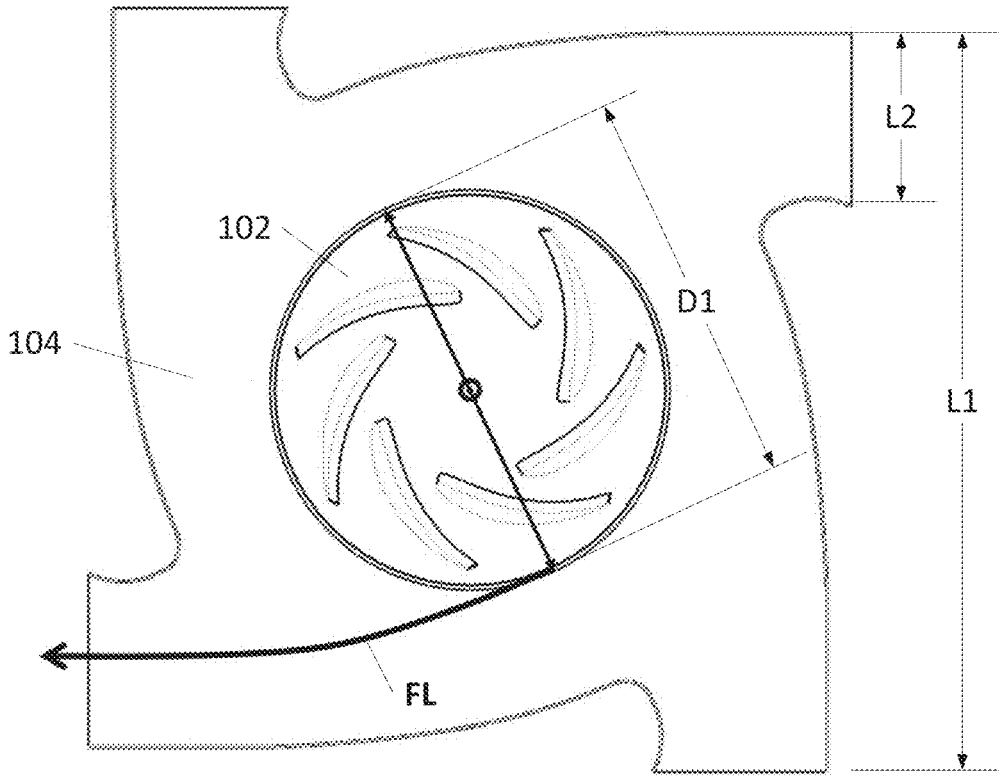
FIG. 16 is a top plan view of the fan assembly housing of FIG. 14 depicting relative dimensions along a plane parallel to the x- and y-axes, in accordance with an embodiment of the disclosure.
Figure 17:
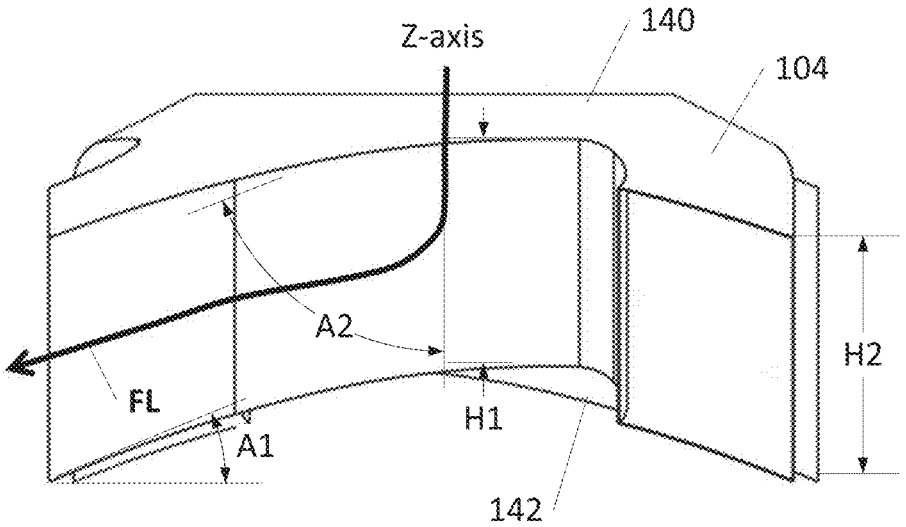
FIG. 17 is a profile view of the fan assembly housing of FIG. 14 depicting relative dimensions along a plane parallel to the x- and z-axes, in accordance with an embodiment of the disclosure.

As depicted in FIGS. 15-17, each of the sidewalls 144, 146, 148, and 150 can be identical, with each sidewall 144, 146, 148, and 150 defined by a first length L1 and a first height H1, while the openings 144*c*, 146*c*, 148*c*, and 150*c* can each be defined by a second length L2 and the second height H2. In some examples, the first length L1 is between one and a half and two and a half times the diameter D1 of the centrifugal fan 102 (i.e., $1.5 \cdot D1 \leq L1 \geq 2.5 \cdot D1$). In some examples, configurations where L1 is about 1.86 times the diameter D1 exhibit improved efficiency, particularly over housing configurations of the prior art. Further efficiency gains can be observed where the height H2 of the of each opening 144*c*, 146*c*, 148*c*, and 150*c* is made close to the height H1 of the sidewalls 144, 146, 148, and 150.

The transition portions 144*b*, 146*b*, 148*b*, and 150*b* can be provided with both convex and concave curved portions (with respect to an x- or y-axis of the fan assembly 100), such that the transition portions 144*b*, 146*b*, 148*b*, and 150*b* (alternatively referred to as a tongue or tongue portion) can be characterized as having a compound curve shape. Alternatively, as depicted in FIGS. 19-23, the transition portions 144*b*, 146*b*, 148*b*, and 150*b* can be provided with a single curve (e.g., concave curve) relative to the x- and y-axes. For example, as depicted in FIG. 15, at least a portion of the transition portions 144*b*, 146*b*, 148*b*, and 150*b* can follow a curve having a diameter D2, which can range from between about one and a half times D1 and about 4 times D1 (i.e., $1.5 \cdot D1 \leq D2 \geq 4 \cdot D1$). In some embodiments, the sidewalls 144, 146, 148, and 150 can be characterized as defining a plurality of volute, curved, spiral, or scroll shaped portions extending between adjacent openings 144*c*, 146*c*, 148*c*, and 150*c*, particularly when the housing 104 encompasses a number of sides or openings greater than or fewer than four.

In some embodiments, each of the concave-shaped segments of the transition portions 144*b*, 146*b*, 148*b*, and 150*b* can be characterized as defining a curved, smooth surface to direct a portion of the airflow generated by the centrifugal fan 102 out of the respective openings 144*c*, 146*c*, 148*c*, and 150*c* and as defining a curved, smooth surface to direct another portion of the airflow generated by the centrifugal fan 102 towards the next, downstream 144*c*, 146*c*, 148*c*, and 150*c*, via volute portions. In particular, each of the main portions 144*a*, 146*a*, 148*a*, and 150*a* can merge into the transition portions 144*b*, 146*b*, 148*b*, and 150*b* to follow an efficient flow line (FL), thereby guiding a flow of air exiting the centrifugal fan during operation. For example, as depicted, the transition portions 144*b*, 146*b*, 148*b*, and 150*b* can curve towards the centrifugal 102 (e.g., away from planar main portions 144*a*, 146*a*, 148*a*, and 150*a*), then more abruptly curve away from the centrifugal fan 102 terminating in the openings 144*c*, 146*c*, 148*c*, and 150*c*.

In some embodiments, each of the sidewalls 144, 146, 148, and 150 can be identical to each other. Alternatively, the fan assembly 100 can be formed with distinct sidewall configurations that differ from each other in some respects without departing from the concepts presented herein. For example, the sidewalls 144 and 148 could be provided without the transition portions 144*b*, 148*b* and openings 144*c*, 148*c*, while sidewalls 146, 150 could be provided as depicted. Although the main portions 144*a*, 146*a*, 148*a*, and 150*a* are shown as being entirely planar, the main portions 144*a*, 146*a*, 148*a*, and 150*a* may also be provided with a curved shape. Other sidewall configurations are also contemplated In the example shown at FIGS. 14-17, the four openings 144*c*, 146*c*, 148*c*, and 150*c* generally define quadrilateral shaped openings that extend fully between the end walls 140, 142 such that the heights of the housing 104 and openings 144*c*, 146*c*, 148*c*, and 150*c* are substantially equal. In other embodiments, the openings 144*c*, 146*c*, 148*c*, and 150*c* can have an obround, oval, circular, or other shapes. Further, the openings 144*c*, 146*c*, 148*c*, and 150*c* can have a height H2 that is less than the height H1 between the end walls 140, 142.

Figure 19:
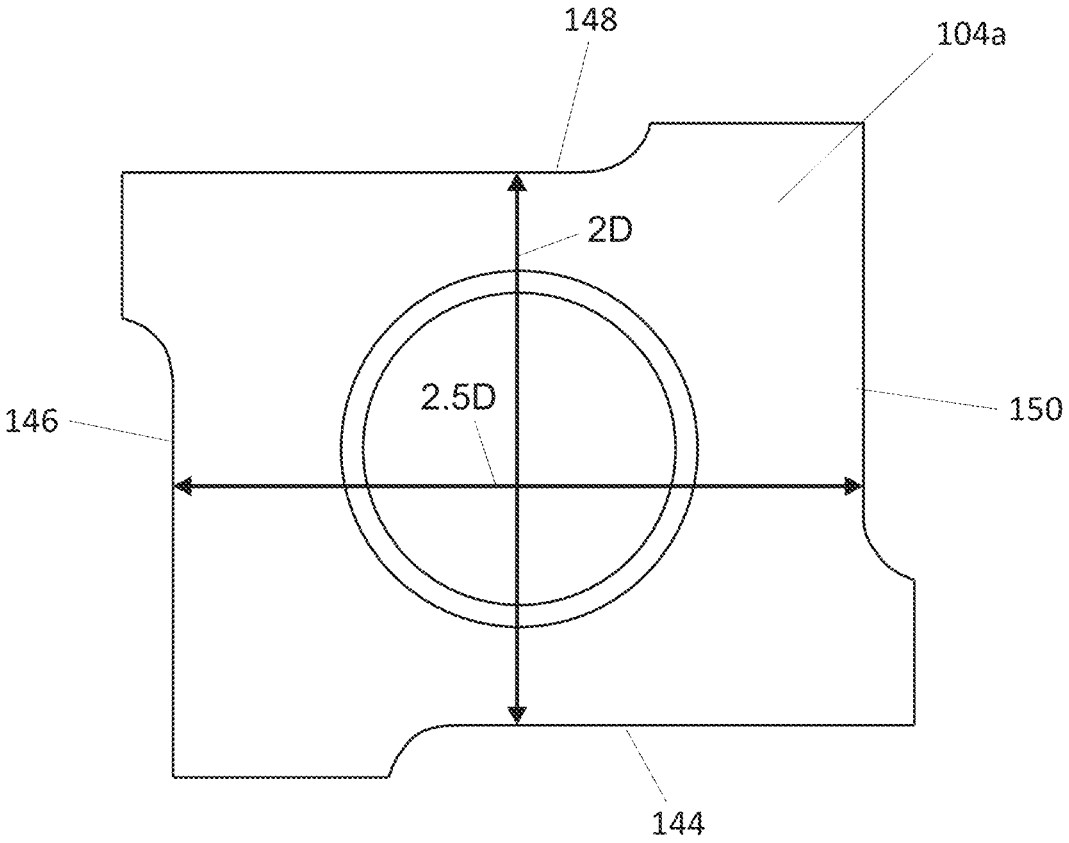
FIG. 19 is a top plan view of a fan assembly housing having dimensions tied to a fan wheel diameter, in accordance with a alternative embodiment of the disclosure.

With reference to FIGS. 19-23, alternative housing 104 configurations are depicted in accordance with embodiments of the disclosure. As shown in FIG. 19, a housing 104*a* is provided in which one pair of sidewalls 144, 148 can be spaced apart from one another by a distance equal to about twice the centrifugal fan 102 diameter D1, while the another pair of sidewalls 146, 150 can be spaced apart from one another by a distance equal to about 2.5 times the fan diameter D1.

Additionally, FIG. 19 depicts a housing 104*a* in which two opposite sides 144, 148 have larger openings 144*c*, 148*c* in comparison to the other two sides 146, 150. Such a configuration may be advantageous where it is desirable to direct more airflow in a given direction(s) while reducing airflow in the other direction(s), for example, to reduce airflow cross-communication with adjacent fan(s) in a fan array.

Figure 20:
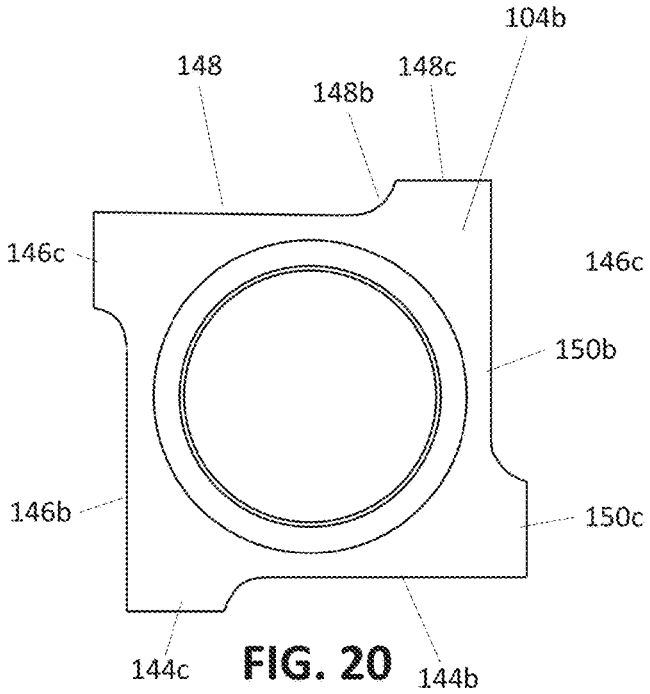
FIG. 20 is a top plan view of a first quadrilateral fan assembly housing, in accordance with an embodiment of the disclosure.
Figure 21:
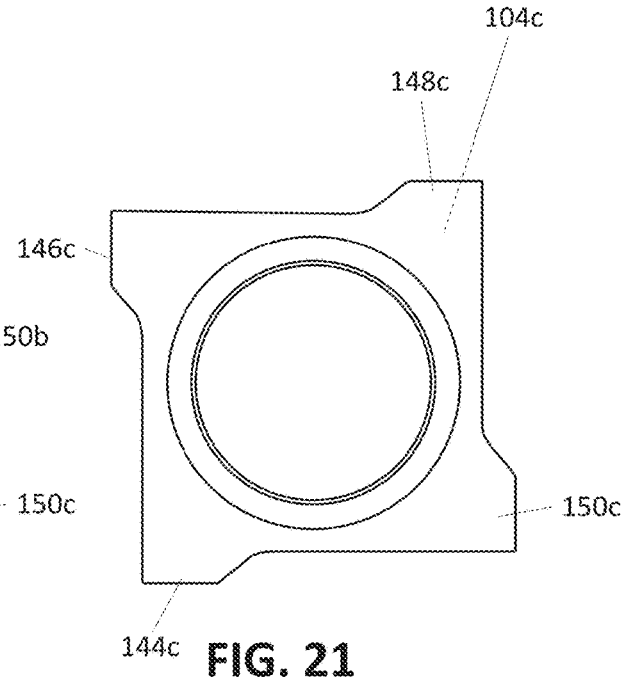
FIG. 21 is a top plan view of a second quadrilateral fan assembly housing, in accordance with an embodiment of the disclosure.
Figure 22:
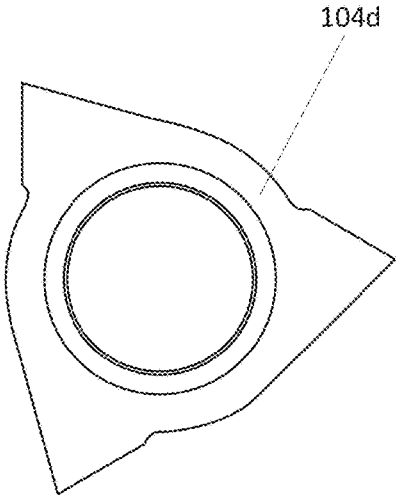
FIG. 22 is a top plan view of a fan assembly housing having three sides, in accordance with an embodiment of the disclosure.
Figure 23:
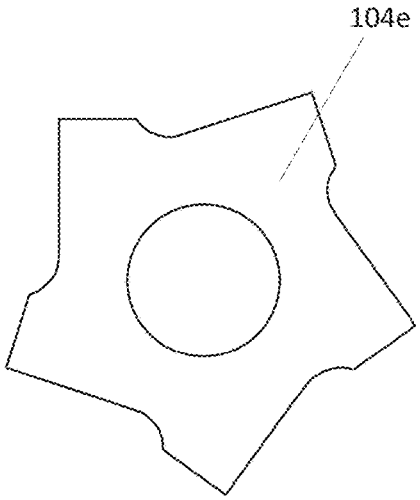
FIG. 23 is a top plan view of the fan assembly housing having five sides, in accordance with an embodiment of the disclosure.
Figure 24:
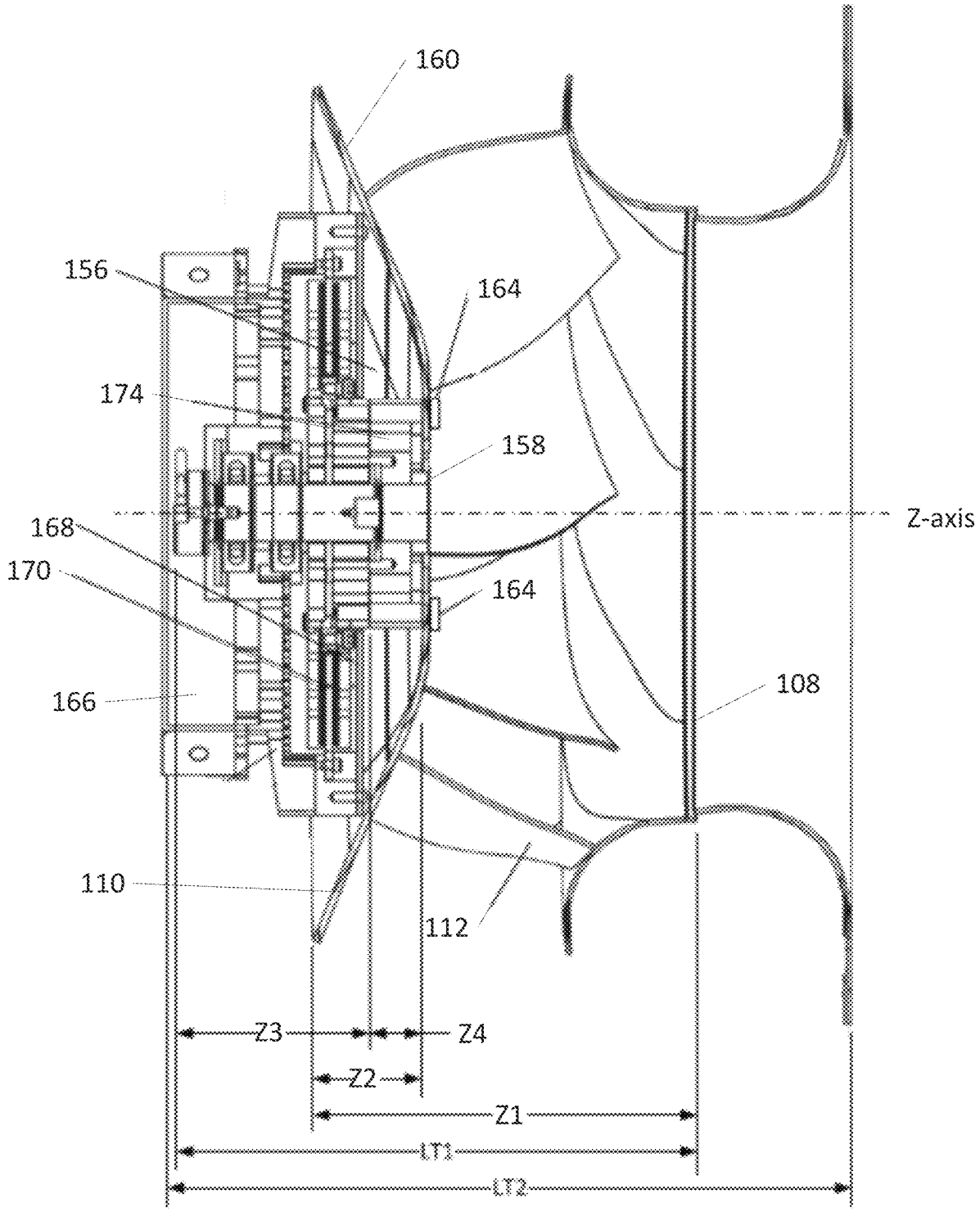
FIG. 24 is a cross-sectional, profile view depicting a fan motor assembly, in accordance with an embodiment of the disclosure.
Figure 25:
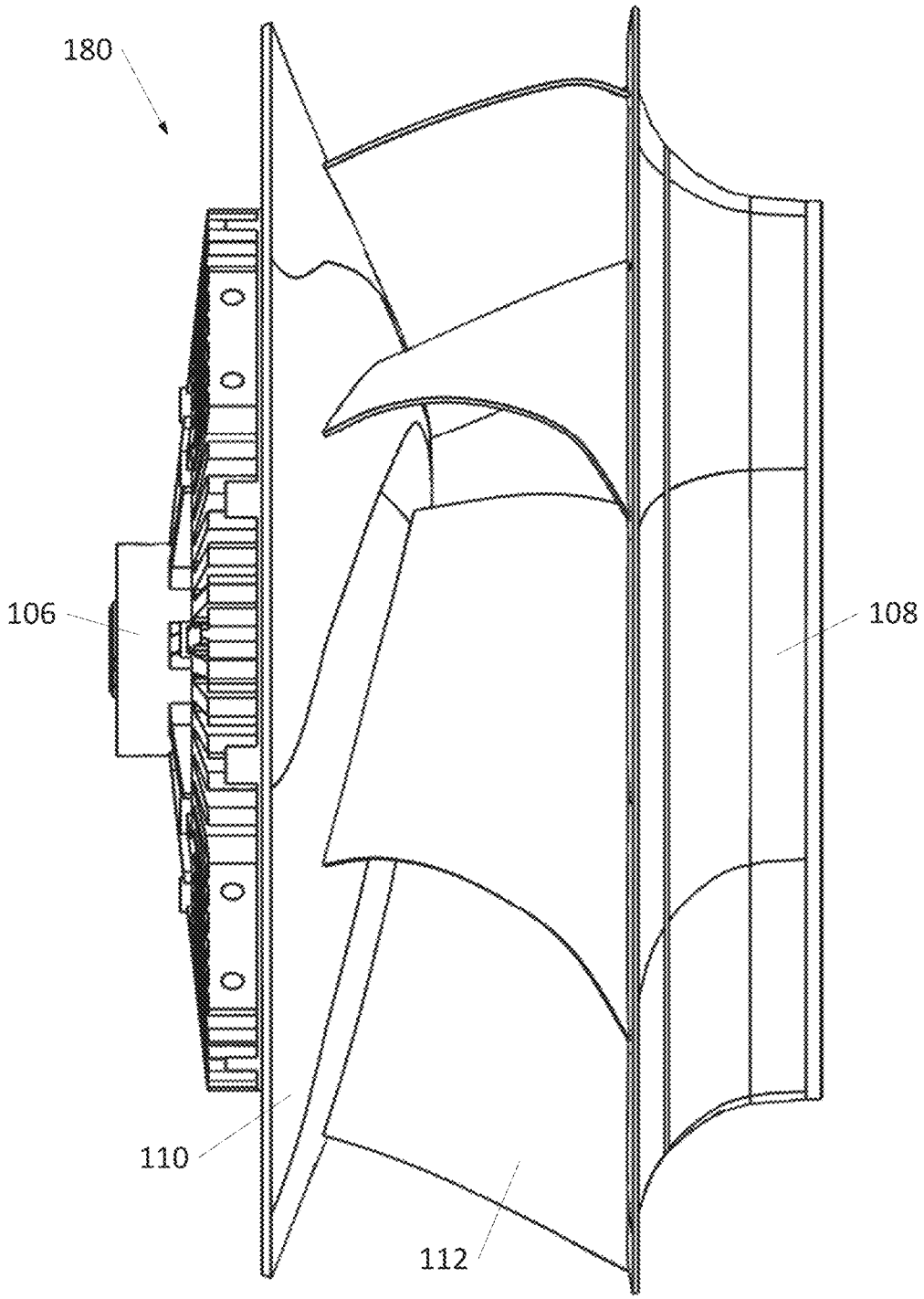
FIG. 25 is a profile view depicting an assembled fan motor assembly, in accordance with an embodiment of the disclosure.
Figure 26:
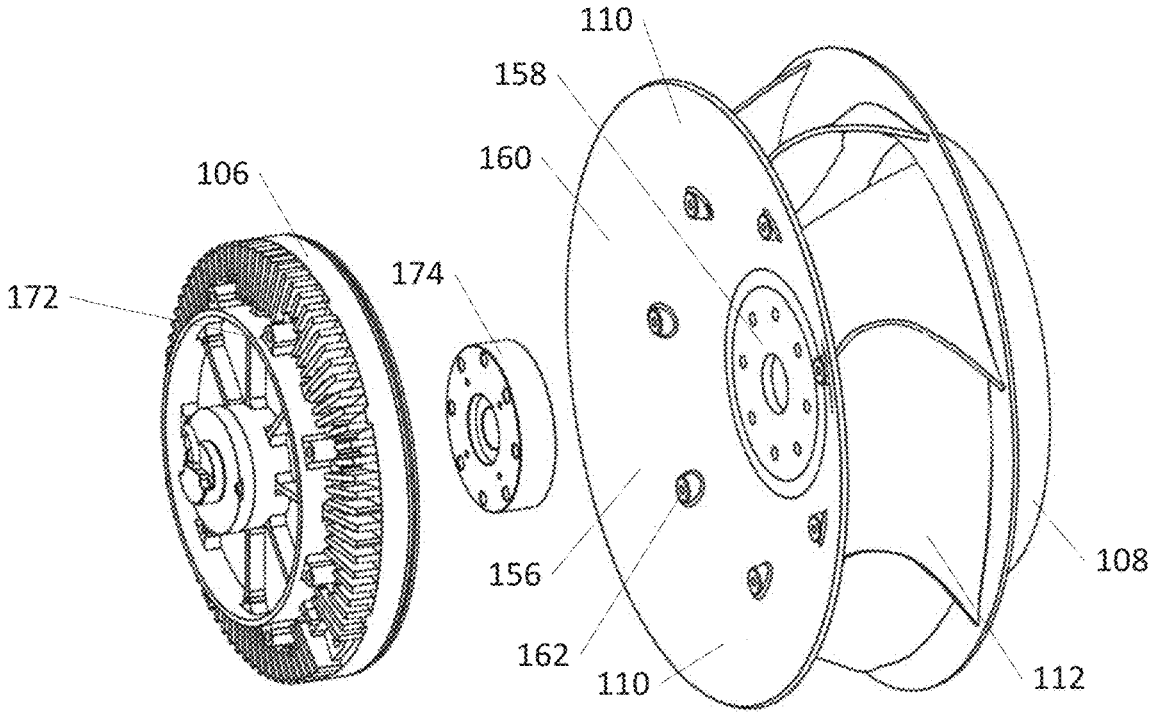
FIG. 26 is an exploded, prospective view depicting a fan motor assembly, in accordance with an embodiment of the disclosure.
Figure 27:
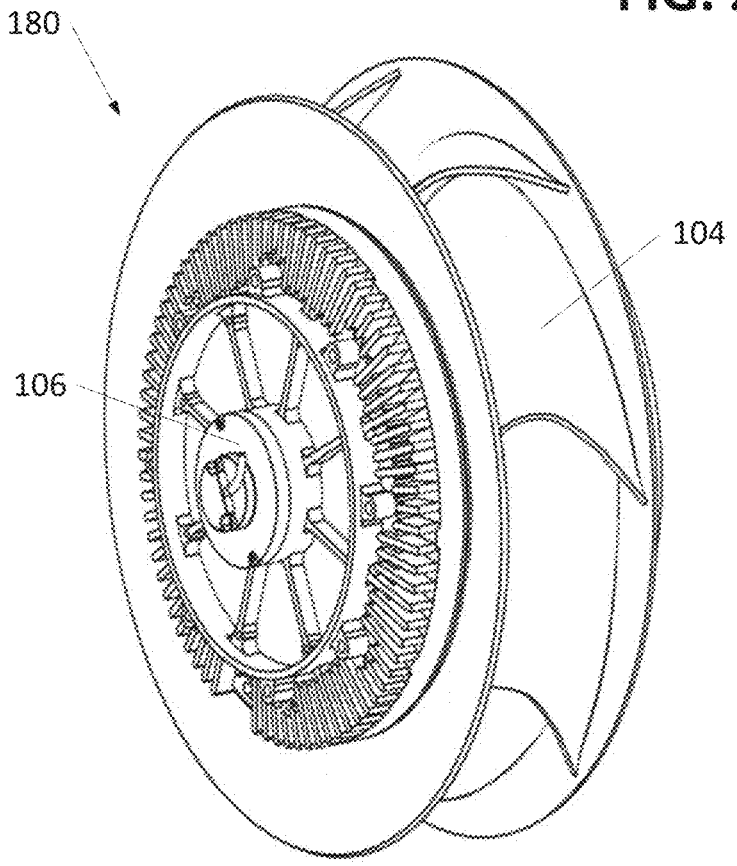
FIG. 27 is a perspective view depicting the fan motor assembly of FIG. 26, in accordance with an embodiment of the disclosure.

As shown at FIG. 20, a housing 104*b* is provided in which the transition portions 144*b*, 146*b*, 148*b*, and 150*b* are provided with a single curve that is concave relative to the x- and y-axes of the housing 104*b*. Accordingly, the housing 104 has generally straight sidewalls 144, 146, 148, and 150 that curve radially outward to the openings 144*c*, 146*c*, 148*c*, and 150*c*. FIG. 21 shows a housing 104*c* with a configuration similar to that of FIG. 20, but where an area of the openings 144*c*, 146*c*, 148*c*, and 150*c* is reduced. In some embodiments, reducing the area of the openings 144*c*, 146*c*, 148*c*, and 150*c* can result in increased total efficiency. The housing 104*d* shown at FIG. 22 illustrates an embodiment with three openings instead of four openings, while the housing 104*e* shown at FIG. 23 illustrates an embodiment with five openings. Alternative housings with greater or fewer number of openings than those depicted are also contemplated.

In some embodiments, the openings can be located between parallel planes defined by the sidewalls, meaning that the openings are positioned within a specific radial range relative to the centrifugal fan 102 and are enclosed by the sidewalls 144, 146, 148, 150. In other embodiments, such as that depicted in FIGS. 14-17, the openings 144*c*, 146*c*, 148*c*, and 150*c* can be located beyond a plane defined by the main portions 144*a*, 146*a*, 148*a*, and 150*a*, meaning that the openings extend outwardly from the main portions 144*a*, 146*a*, 148*a*, and 150*a* in a radial direction, protruding beyond the main portion 144*a*, 146*a*, 148*a*, and 150*a* planes. In yet other embodiments, the openings can be positioned within the same plane as the main portions 144*a*, 146*a*, 148*a*, and 150*a* (coplanar), meaning that the openings 144*a*, 146*a*, 148*a*, and 150*a* may share the same plane as the main portions 144*a*, 146*a*, 148*a*, and 150*a* or intersect with the sidewalls at one or more point along the side wall 144, 146, 148, 150.

Nonlimiting embodiments of the fan assembly 100 can be provided in the following configurations:

| RPM | Fan Wheel Size Diameter (in) | Fan Wheel Weight (lbs.) | Motor Size Diameter (in) | Motor Weight (lbs.) |
|---|---|---|---|---|
| 3180 | 16 | 15.4 | 13 | 38 |
| 2800 | 18 | 18.7 | 14 | 38 |
| 2100 | 20 | 24.5 | 16 | 38 |
| 2525 | 20 | 38.8 | 16 | 38 |
| 1880 | 22 | 45.2 | 18 | 38 |
| 1675 | 24 | 60.2 | 19 | 50 |

With reference to FIG. 17, the fan assembly 100 is shown with the second end (e.g., rear) wall 142 having a curved surface. For example, as depicted, the curved surface can be a continually curved surface; alternatively, the first end wall 140 can include a plurality of angled straight sections to approximate a curved surface. In the depicted example, the curved surface has an average angle A1 in a range of between about 15 degrees and about 30 degrees from the first end wall 140 and an average angle A2 about 75 degrees from the z-axis. Accordingly, the second end wall 142 can be characterized as extending at an oblique angle to both the first end wall 140 and the z-axis.

In one embodiment, the curved surface is closest to the first end wall 140 along the z-axis at a midpoint along the second end wall 142, and furthest from the first end wall 140 along the z-axis at the respective ends of the second and wall 142. Stated another way, the distance in the axial direction (e.g., along the z-axis) between the walls 140, 142 is the shortest in proximity to the central air inlet aperture 116 and largest proximate the outer perimeter of the housing 140. That is, the curved surface of the second and wall 142 can extend away from the first end wall 140 in a direction along the Z axis towards an outer perimeter 120 of the housing 104.

Referring to FIG. 15-17, the airflow path through the housing 104 is illustrated by flowlines (FL). These flowlines can extend outward from the centrifugal fan 102, following a tangent to the outer diameter D1, and traverse through each of the openings 144*c*, 146*c*, 148*c*, and 150*c*, and can be regarded as establishing an average airflow direction at the locations of the openings 144*c*, 146*c*, 148*c*, and 150*c*. Accordingly, in some embodiments, the curved second end wall 142 can be shaped to facilitate a more natural trajectory for the airflow generated by the centrifugal fan 102, resulting in reduced resistance as the flowlines traverse the housing 104, which serves to increase operational efficiency.

Figure 18:
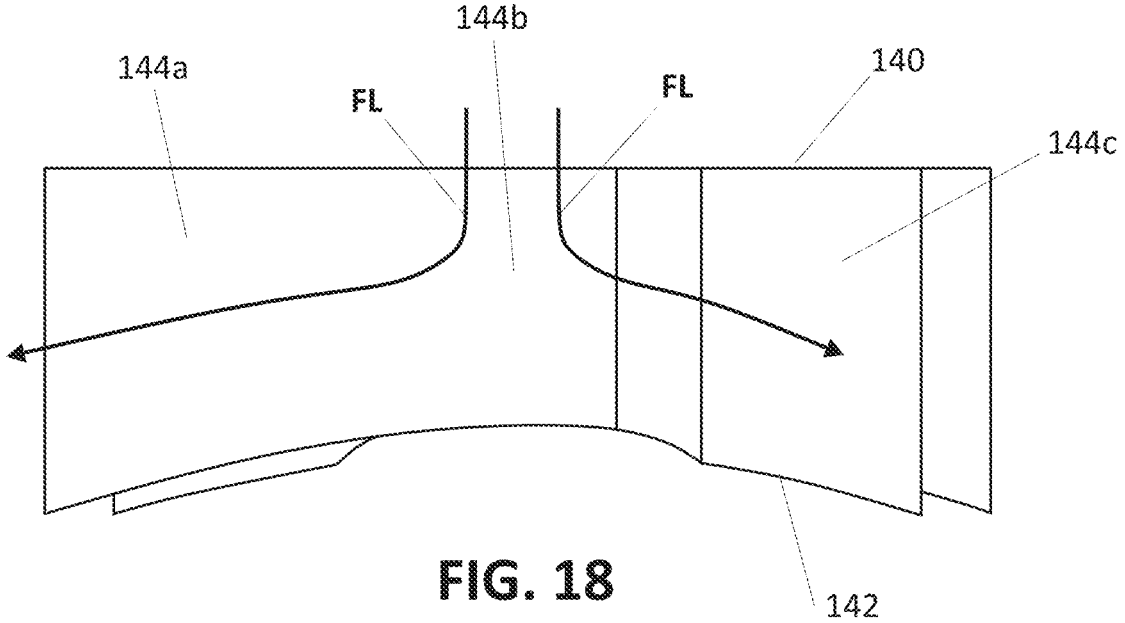
FIG. 18 is a profile view of a fan assembly housing having a planar top wall and a curved bottom wall, in accordance with embodiment of the disclosure.

As depicted in FIGS. FIG. 17, the fan assembly 100 is shown with both the first end wall 140 and the second end wall 142 defining curvatures. In some embodiments, the first and second end walls 140, 142 can define curvatures that are generally parallel to each other. As described above, such a configuration may enable the airflow to be guided by the housing 104 to each of the openings 144*c*, 146*c*, 148*c*, and 150*c* in a more natural flow path that reduces interference between the airflow and the housing 104, which results in improved efficiency. When airflow is generated by the fan assembly 100, the airflow may generally follow the depicted airflow lines (FL) through each of the openings 144*c*, 146*c*, 148*c*, and 150*c*. Curvature of both the first and second end walls 140, 142 can generally serve to reduce abrupt directional changes, resulting in less resistance or interference in comparison to a fan assembly 100 with non-curved (e.g., straight) first and second end walls 140, 142. In other embodiments, the first end wall 140 can be substantially planar, such as that depicted in FIG. 18.

With additional reference to FIGS. 24-27, in some embodiments, wheel back 110 of the centrifugal fan 102 can define an interior region 156 for mounting of the electric motor 106. In particular, the centrifugal fan 102 can extend along the z-axis between the wheel cone 108 and the wheel back 110 to define a first distance Z1, with the wheel back 110 having a curved cross-sectional profile that varies along the z-axis to define the interior region 156 having a depth represented by a second distance Z2. As depicted, the wheel back 110 can include a substantially planar central portion 158 positioned substantially orthogonal to the z-axis, with a frusto-conical shaped outer portion 160 defining the interior region 156. In other configurations, the wheel back 110 can have a curved or dome-shaped profile to define the interior region 156. To facilitate connection of the electric motor 106 to the centrifugal fan 102, in some embodiments, the wheel back 110 can define a plurality of apertures 162 arranged in a pattern (e.g., circular pattern, etc.), configured to receive a corresponding plurality of fasteners 164 to secure the electric motor 106 to the centrifugal fan 102.

In some of embodiments, the electric motor 106 can include a motor housing 166 extending along the z-axis a third distance Z3. In some embodiments, the third distance Z3 can be about half of the first distance Z1. The electric motor 106 can include a stator assembly 168 and a rotor assembly 170 supported by the motor housing 166. When the electric motor 106 is energized, the stator assembly 168 causes the rotor assembly 170 to rotate. In the example shown, the rotor assembly 170 is provided with a plurality of apertures 172 arranged in a pattern matching the apertures 162 such that the fasteners 164 can operably couple the centrifugal fan 102 to the electric motor 106, while the stator assembly 168 can be operably coupled to the housing 104.

In the example shown, the electric motor 106 is configured as a, electronically commutated motor (ECM), alternatively referred to as an axial flux motor, axial gap motor or pancake motor, which uses electronic controls instead of brushes and commutators. With such a motor, the stator assembly 168 and the rotor assembly 170 are separated by an axially gap extending parallel to the axis of rotation, which results in a magnetic flux being generated substantially parallel to the axis of rotation. By using such a motor, the third distance Z3 (e.g., the depth of the motor housing 166) can be made significantly less than the first distance Z1 (e.g., the depth of the centrifugal fan 102); although the use of other types of electric motors is contemplated.

As further depicted, in some embodiments, the electric motor 106 can include a spacer block 174, also defining a plurality of apertures 176 arranged in the same pattern as apertures 162 and 172, thereby enabling the fasteners 164 to pass through the spacer block 174. In some embodiments, the spacer block 174 can extend along the z-axis a fourth distance Z4. In some embodiments, the fourth distance Z4 (e.g., the depth of the spacer block 174) can be less than the second distance Z2 (e.g., the depth of the interior region 156).

In some embodiments, the spacer block 140 can be entirely disposed within the interior region 156 defined by the wheel back 110, while the motor housing 166 can be partially disposed within the interior region 156. With such a configuration, the fan-motor assembly 180 can have a total axial length LT1 that is less than the sums of not only the individual distances Z1, Z3, Z4 of the individual components (e.g., the depth of the centrifugal fan 102, motor housing 166 and spacer block 174), but also is less than the sum of distances Z1, Z3 of the centrifugal fan 102 and motor housing 166. In the particular example shown, the majority of the third distance Z3 of the motor housing 166 is disposed within the interior region 156 of the centrifugal fan 102. As a result, an overall length LT2 of the fan-motor assembly 180 and the housing 104 is also reduced in comparison to conventional HVAC fan arrangements. Accordingly, the disclosed configuration represents a highly compact fan arrangement with a significantly reduced axial length in comparison to conventional fan-motor assemblies. Moreover, the reduced axial length adds to the convenience of transporting and installing the disclosed fan assemblies 100 compared to traditional fan assemblies, which not only saves time but also contributes to a reduction in maintenance costs associated with the fan assembly 100.

By incorporating multiple outlet openings 144*c*, 146*c*, 148*c*, and 150*c* to facilitate the airflow generated by the centrifugal fan 102, the depicted embodiments enable for the recovery of static pressure at the discharge of the centrifugal fan 102. Consequently, embodiments of the fan assembly 100 offer improvements in both static and total efficiency in comparison to traditional plenum fans or housed centrifugal fans. Accordingly, the housing 104, when utilized in conjunction with the improved centrifugal fan 102, is particularly advantageous for enhancing the performance of low-efficiency traditional fans, such that, retrofitting an existing centrifugal fan with the housing 104 (e.g., adding the housing 104 to surround an existing fan wheel) or replacing an inefficient fan wheel assembly with the fan assembly 100 can greatly enhance operational efficiency of the HVAC system.

In particular, calculations and testing have demonstrated efficiency enhancements achievable by incorporating the housing 104 in existing fan configurations. For instance, a low-efficiency fan wheel with initial static and total efficiencies of 61% can be elevated to a static efficiency exceeding 70% and a total efficiency of 80% with the inclusion of the housing 104.

Figure 28:
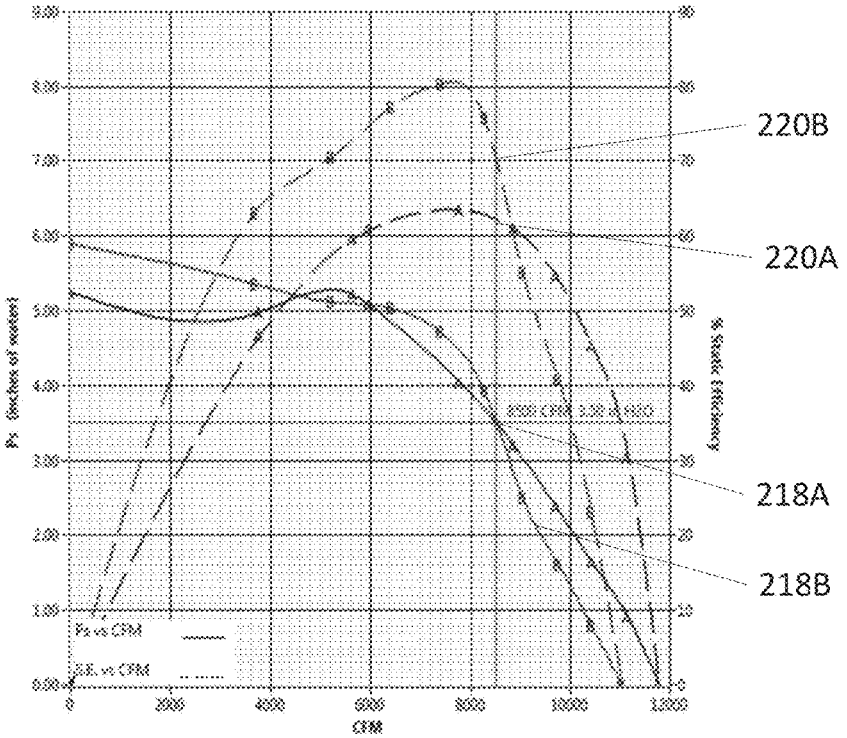
FIG. 28 graphical representation comparing an existing fan configuration in an un-housed state with an existing fan configuration in a housed state, in accordance with an embodiment of the disclosure.

For example, with reference to FIG. 28, in a practical comparative test conducted at 1800 RPM, 8,500 CFM, and 3.5 inches of static pressure, both with and without the housing 104, the results showcased an impressive improvement. As depicted, curve 218A represents a range of flow rates (i.e., represented in cubic feet per minute) output by an existing centrifugal fan in an un-housed state over a corresponding range of static pressures (Ps) (i.e., represented in inches of water). Curve 218B represents a range of flow rates output by an existing centrifugal fan positioned within a housing 106 over a range of static pressures (Ps). In general, an increase in static pressure (Ps) has a negative effect on the flow rate, with the maximum flow rate achieved with the static pressure of zero. Also depicted, is a first static efficiency curve 220A for the existing centrifugal fan in an un-housed state for comparison to a second static efficiency curve 220B for the centrifugal fan positioned within housing 104. As depicted, the test revealed that the efficiency increased from 61% static and 61% total efficiency to 73% static efficiency and 82.3% total efficiency, which corresponds to a performance percentage increase of more than about 12% in static efficiency and an increase of about 10% in total efficiency.

Figure 29:
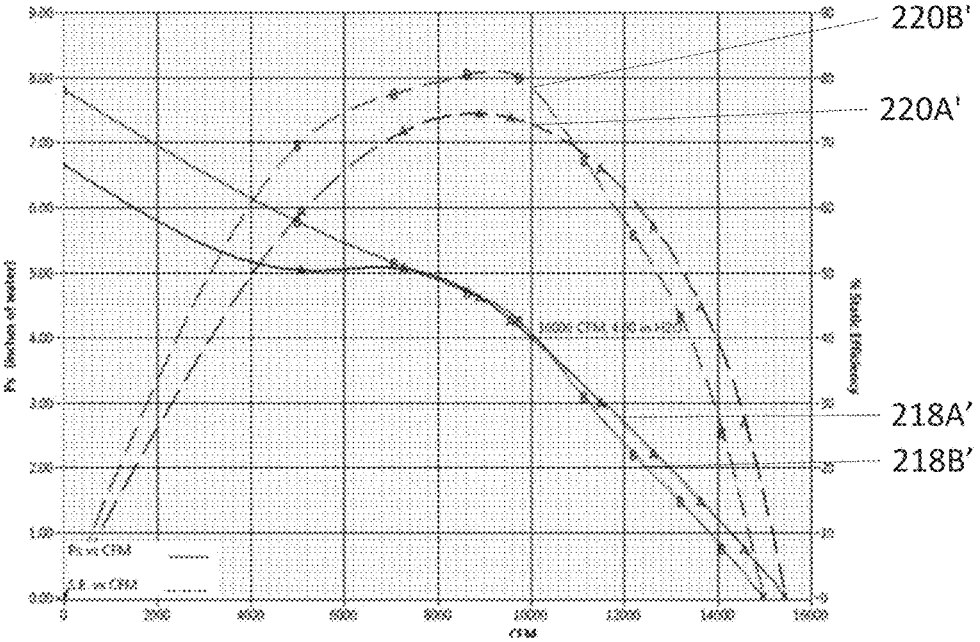
FIG. 29 is a graphical representation comparing a centrifugal fan in an un-housed state with centrifugal fan in a housed state, in accordance with an embodiment of the disclosure.

Significant efficiency improvements can also be achieved with high-efficiency fan wheels, such as the disclosed centrifugal fan 102. With reference to FIG. 29, in a practical comparative test conducted at 1650 RPM, 10,000 CFM, and 4 inches of static pressure, both with and without the housing 104, the results showcased an impressive improvement. As depicted, curve 218A' represents a range of flow output by the un-housed centrifugal fan 102 over a corresponding range of static pressures, and curve 218B' represents a range of flow output by the housed centrifugal fan 102 over the same range of static pressures. Also depicted, is a first static efficiency curve 220A' for the centrifugal fan 102 in the un-housed state for comparison to a second static efficiency curve 220B' for the centrifugal fan 102 positioned within a housing 104. As depicted, the test revealed that the efficiency increased from 74.5% static and 74.5% total efficiency to 78.5% static efficiency and 87% total efficiency, which corresponds to a substantial performance percentage increase of more than about 4% in static efficiency and an increase of about 9% in total efficiency. In yet another example, calculations indicate that a fan assembly 100 equipped with a relatively higher efficiency fan wheel having a static efficiency of 79% and a total efficiency of 79% can be elevated to a static efficiency of and a total efficiency of 89.8% by incorporating the housing 104.

Furthermore, improvements in efficiency achieved through the use of the housing 104 can be compounded when the disclosed fan assemblies 100 are employed in fan array applications. In particular configurations of these fan assemblies 100 are specifically designed to complement each other and work in harmony, for example by reducing or eliminating crosstalk between individual fan assemblies 100 within an array setup (e.g., an airflow exiting one fan assembly interfering with an airflow exiting a second fan assembly, etc.), resulting in enhanced overall performance and efficiency.

Figure 32:
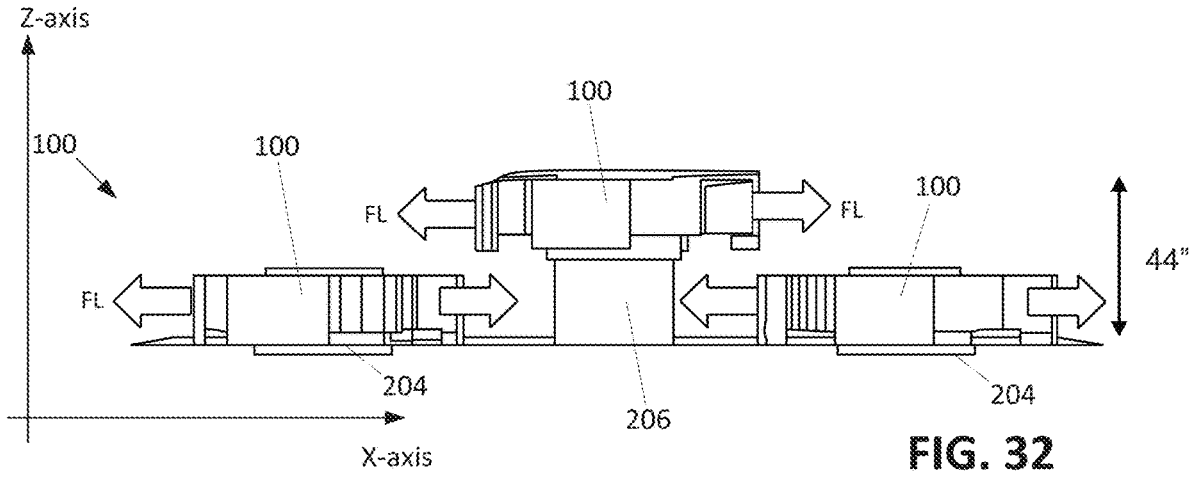
FIG. 32 is an alternative profile view of the fan array of FIG. 29, in accordance with an embodiment of the disclosure.
Figure 33:
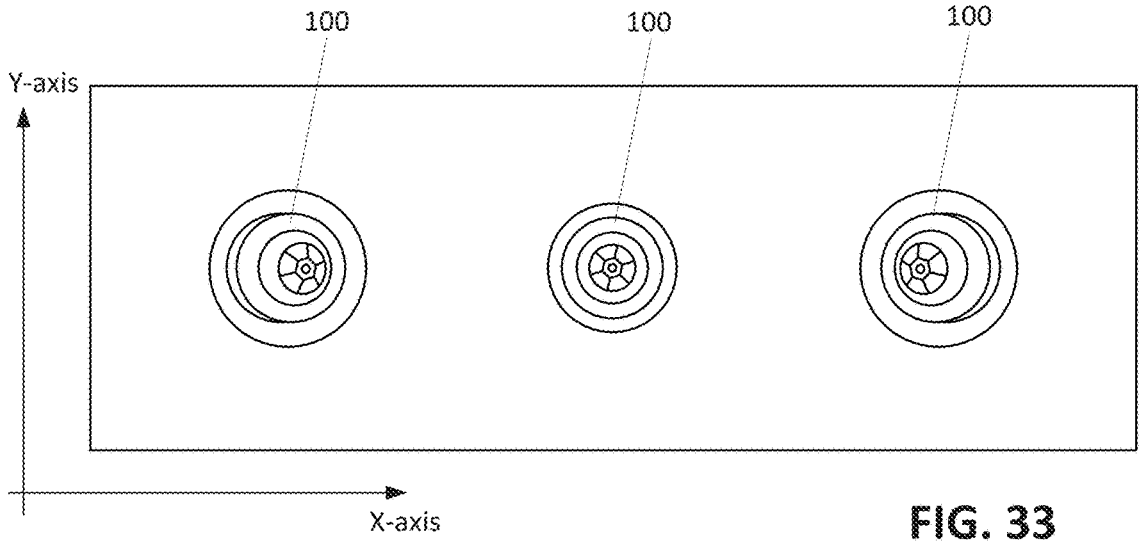
FIG. 33 is a plan view depicting the fan array of FIG. 29, in accordance with an embodiment of the disclosure.
Figure 34:
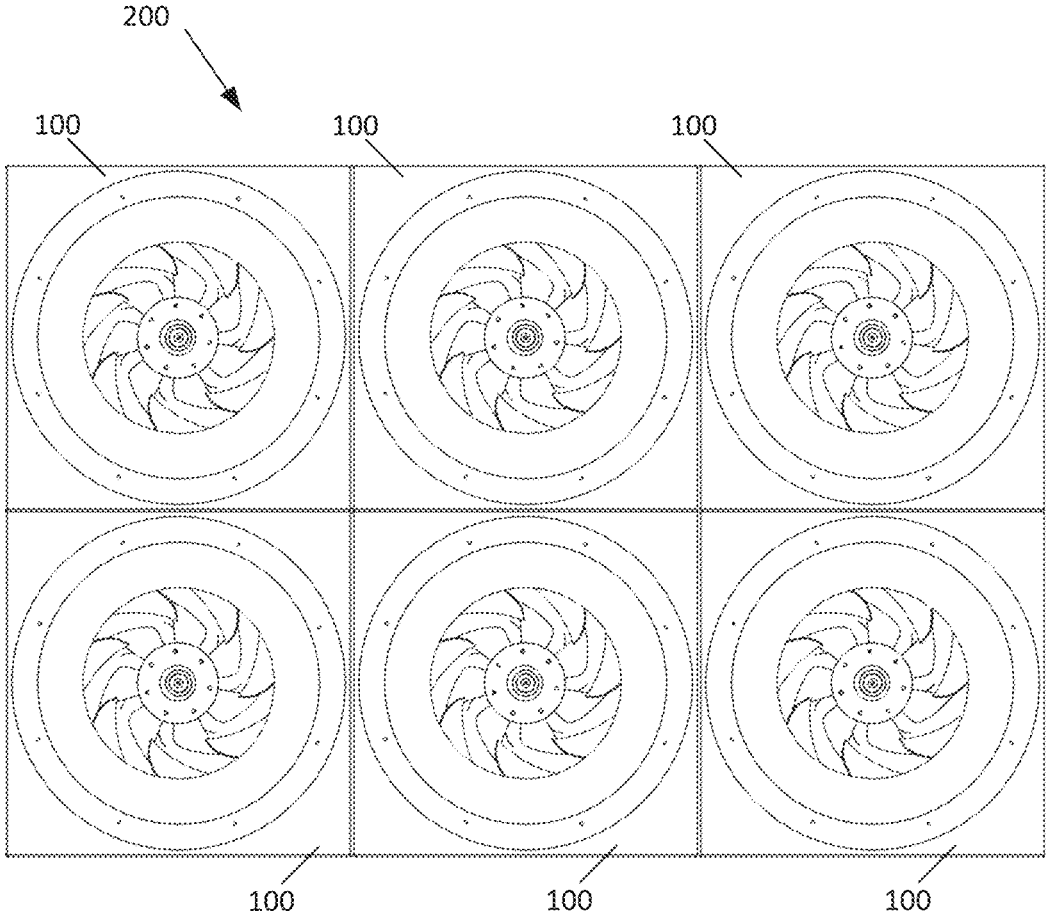
FIG. 34 is a plan view depicting a two-by-array of three fan assemblies, in accordance with an embodiment of the disclosure.

With additional reference to FIGS. 30-34, a fan array 200 including a plurality of the fan assemblies 100 is depicted in accordance with an embodiment of the disclosure. In some examples, the fan array 200 can be located within a compartment of an HVAC air handling unit. For orientation purposes, the fan array 200 can be oriented with respect to a first or horizontal plane extending parallel to the x- and y-axes or a second or vertical plane extending parallel to the z-axis. In some embodiments, the fan array 200 can include a separation wall 202 (e.g., positioned coplanar to either of the horizontal plane or vertical plane) to which the fan assemblies 100 are mounted, for example via mounting members or flanges 204 or by an extension 206 (as depicted in FIG. 32).

Figure 30:
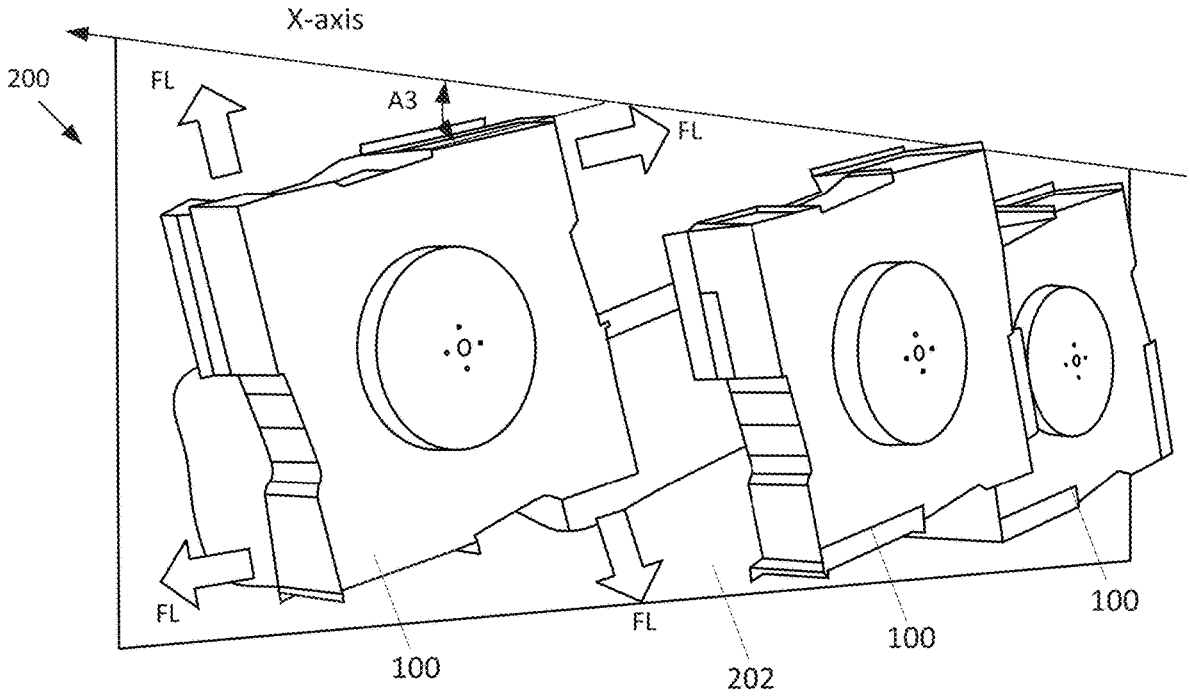
FIG. 30 is a perspective view depicting a plurality of fan assemblies arranged in a fan array, in which the plurality of fan assemblies are rotated relative to a horizontal plane to inhibit interference between air flows exiting the plurality of fan assemblies, in accordance with an embodiment of the disclosure.
Figure 31:
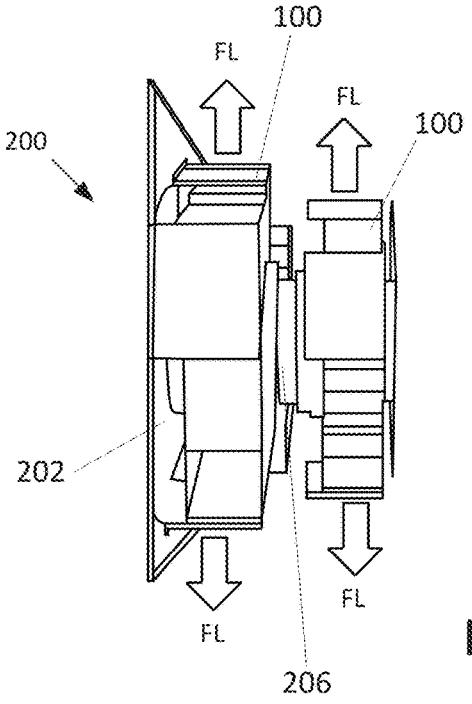
FIG. 31 is a profile view of a plurality of fan assemblies in a fan array, in which the plurality of fan assemblies are positioned at varying heights to inhibit interference between air flows exiting the plurality fan assemblies, in accordance with an embodiment of the disclosure.

In some embodiments, the fan assemblies 100 can be mounted to the separation wall 202 at a rotational orientation relative to the x- or y-axes in which the openings 144*c*, 146*c*, 148*c*, and 150*c* are directed such that they do not directly face an adjacent housing 104 (such as that depicted in FIG. 30). Accordingly, all of the flowlines FL generated by the respective fan assemblies 100 are guided by the housings 104 in a direction away from the other fan assemblies 100 in the array 200. In some embodiments, the fan assemblies 100 can be characterized as having a rotational orientation with respect to their x- or y-axes such that the openings discharge airflow in a direction that is oblique or non-orthogonal to the horizontal plane or the vertical plane.

For example, as depicted in FIG. 30, the fan housings 104 are rotated such that one side wall 144 is disposed at an angle (A3) of about 22.5 degrees from the x-axis (which could equally be applied to the y- or z-axes). In one embodiment, the fan assemblies 100 are oriented such that a flowline FL from the fan wheels 100 (e.g., passing through the openings

144*c*, 146*c*, 148*c*, and 150*c*, do not pass through an adjacent fan assembly housing 104. For example, in one embodiment, the housings 104 are arranged such that no line-of-sight exists from any point on one centrifugal fan 102 to any point on any other centrifugal fan 102 through the openings 144*c*, 146*c*, 148*c*, and 150*c* in the housings 104.

Figure 35:
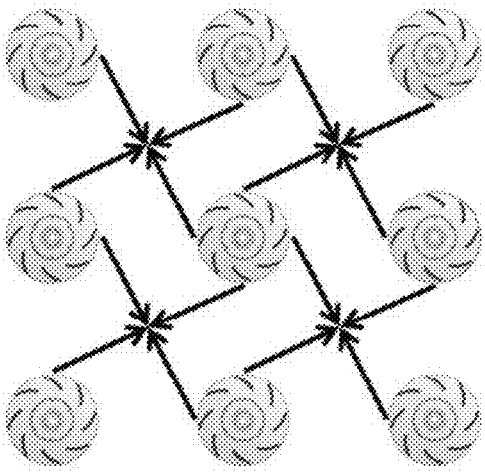
FIG. 35 PRIOR ART
FIG. 35 is a plan view of a fan array of the prior art, in which an interference between air flows exiting the plurality of fan assemblies inhibits optimal performance.
Figure 36:
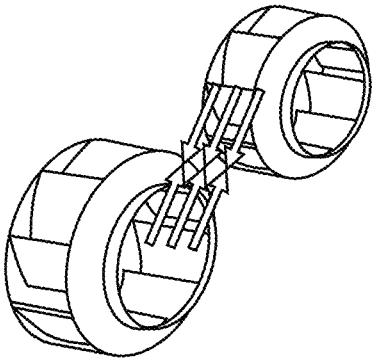
FIG. 36 PRIOR ART
FIG. 36 is a perspective view of a pair of fan assemblies of the prior art positioned adjacent to one another in which interference between air flows exiting the fan assemblies has the effect of reducing the efficiency of the fan assemblies.

In some embodiments, an inlet extension 206 on positioned on one or more of the fan assemblies 100 (as depicted in FIG. 32), which can serve to advantageously offset the openings 144*c*, 146*c*, 148*c*, and 150*c* of one fan assembly 100 from the openings of adjacent fan assemblies 100. Accordingly, in some embodiments, every other fan assembly 100 can have openings positioned at a similar vertical or axial distance from the separation wall 202, thereby further reducing cross-communication of airflow between the fan assemblies 100. With such a configuration, the fan array 200 can significantly increase efficiency in comparison traditional fan arrays (such as that depicted in FIGS. 35-36), in which a plurality of unhoused fans generate unconstrained radial-directed airflows with significant cross-communication.

While the depicted fan array 200 in FIGS. 30-33 include three fan assemblies 100 arranged in a 1×3 array, other embodiments (such as that depicted in FIG. 34) can include array of six fan assemblies 100 in a 3×2 arrangement. Other configurations utilizing any desired number of fan assemblies 100 are also contemplated. Additionally, although, the fan assemblies 100 are depicted as being identical and positioned on the separation wall 202 with similar angular orientations, it is also possible to utilize alternative arrangements by varying the angular orientations of some or all of the fan assemblies 100 and incorporating differently configured fan assemblies 100 into the array.

Moreover, in some embodiments, the fan array 200 can include fan assemblies 100 with a curved first end wall 140, a curved second end wall 142, or with curved first and second end walls 140, 142. For example, a fan array 100 may include one housing 104 with no curved end walls 140, 142, one housing with a curved first end wall 140, and one housing with both the first end wall 140 and the second end wall 142 having a curvature. Any combination of the fan assemblies of the present disclosure are contemplated in fan array 200. The combination of multiple housing 104 arrangements may optimize the space of the fan array 200 and may minimize interference of airflow between the fan assemblies 100. Such a flexibility allows for customization and adaptation of the fan array 200 configuration based on specific requirements or optimization goals.

Figure 37:
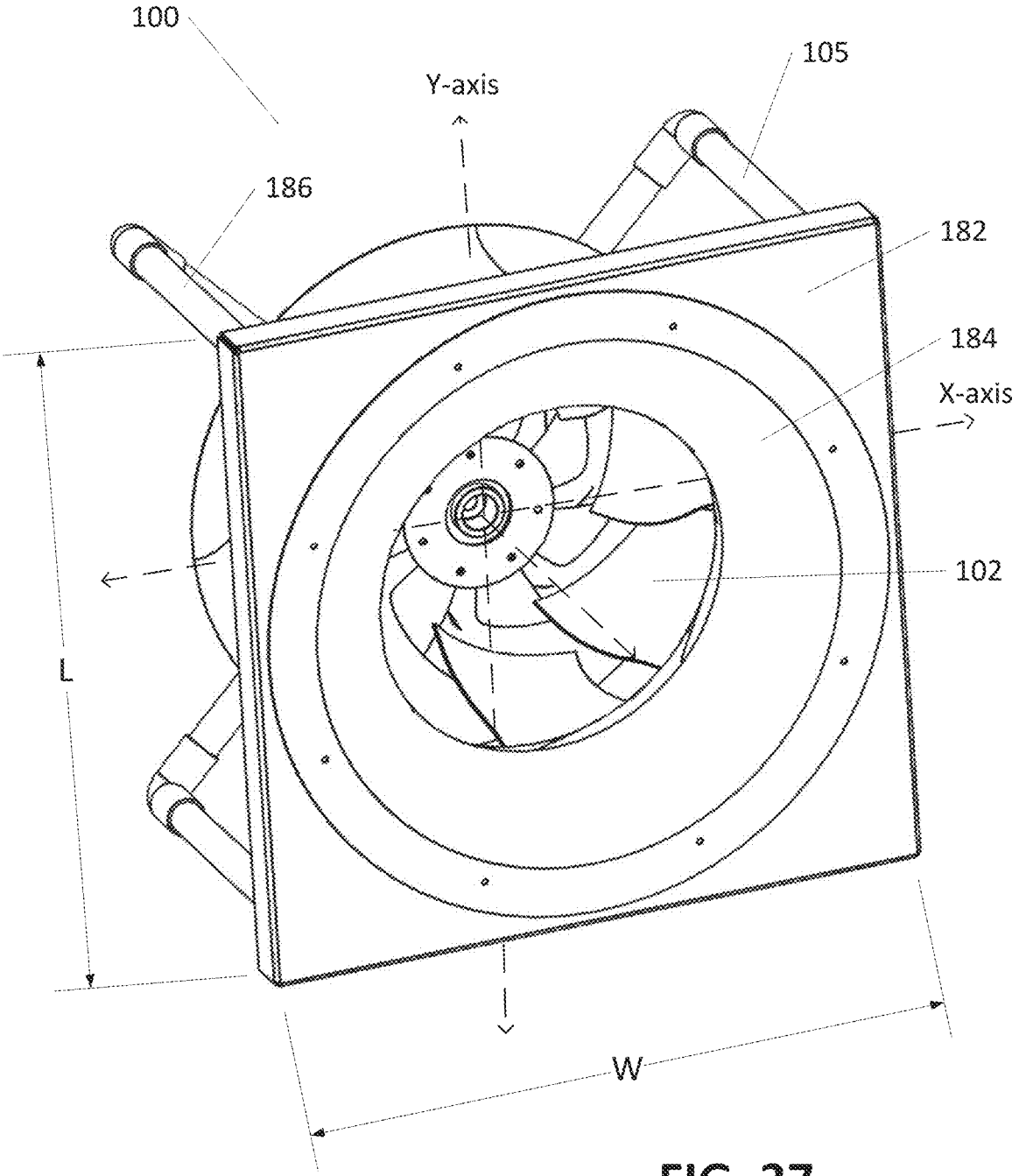
FIG. 37 is a front is a rear perspective view depicting a fan assembly including a frame supporting a motor and centrifugal fan, in accordance with an embodiment of the disclosure.
Figure 38:
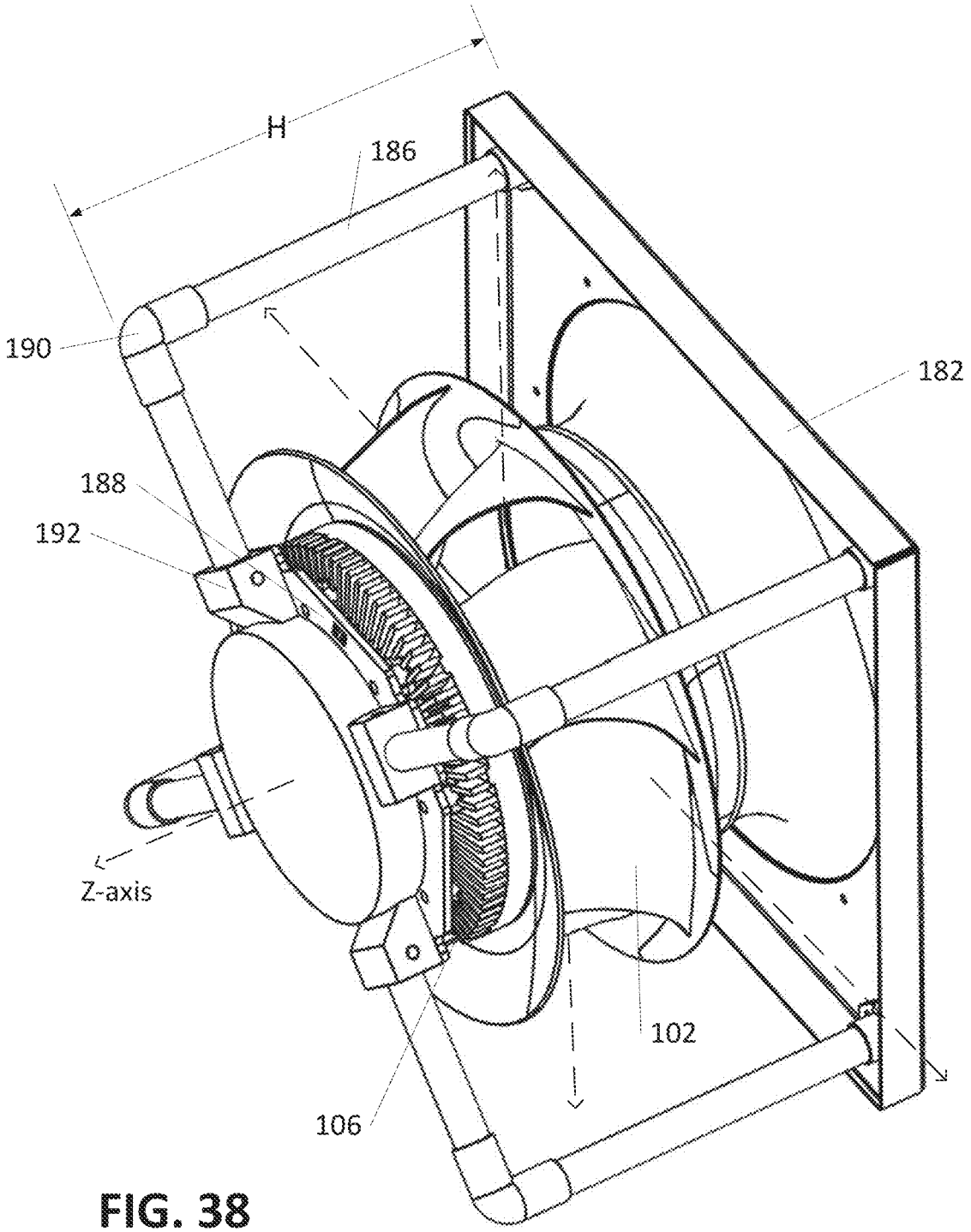
FIG. 38 is a rear perspective view depicting the fan assembly of FIG. 35, in accordance with an embodiment of the disclosure.
Figure 39:
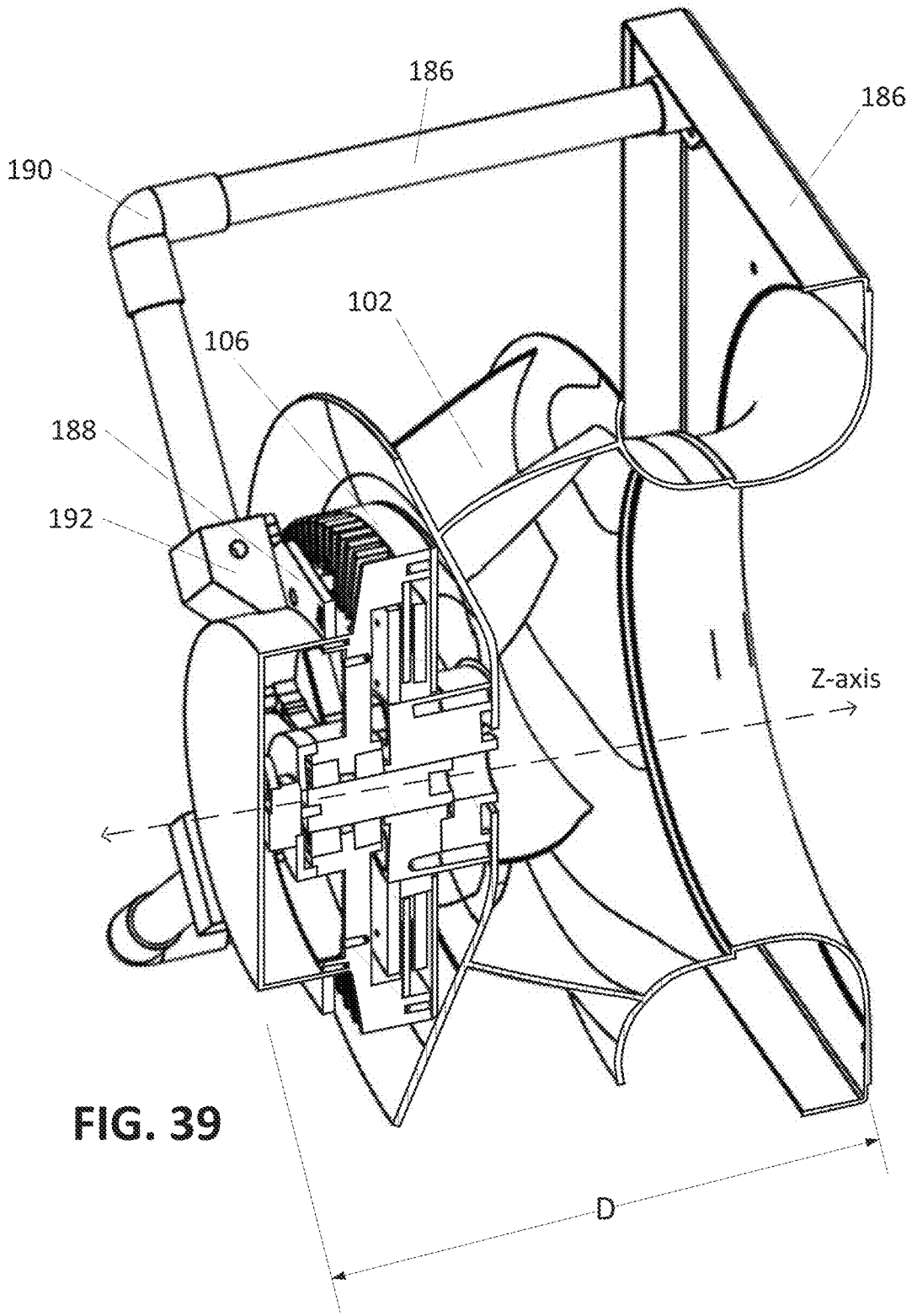
FIG. 39 is a cross-sectional, perspective view depicting the fan assembly of FIG. 35, in accordance with an embodiment of the disclosure.
Figure 40:
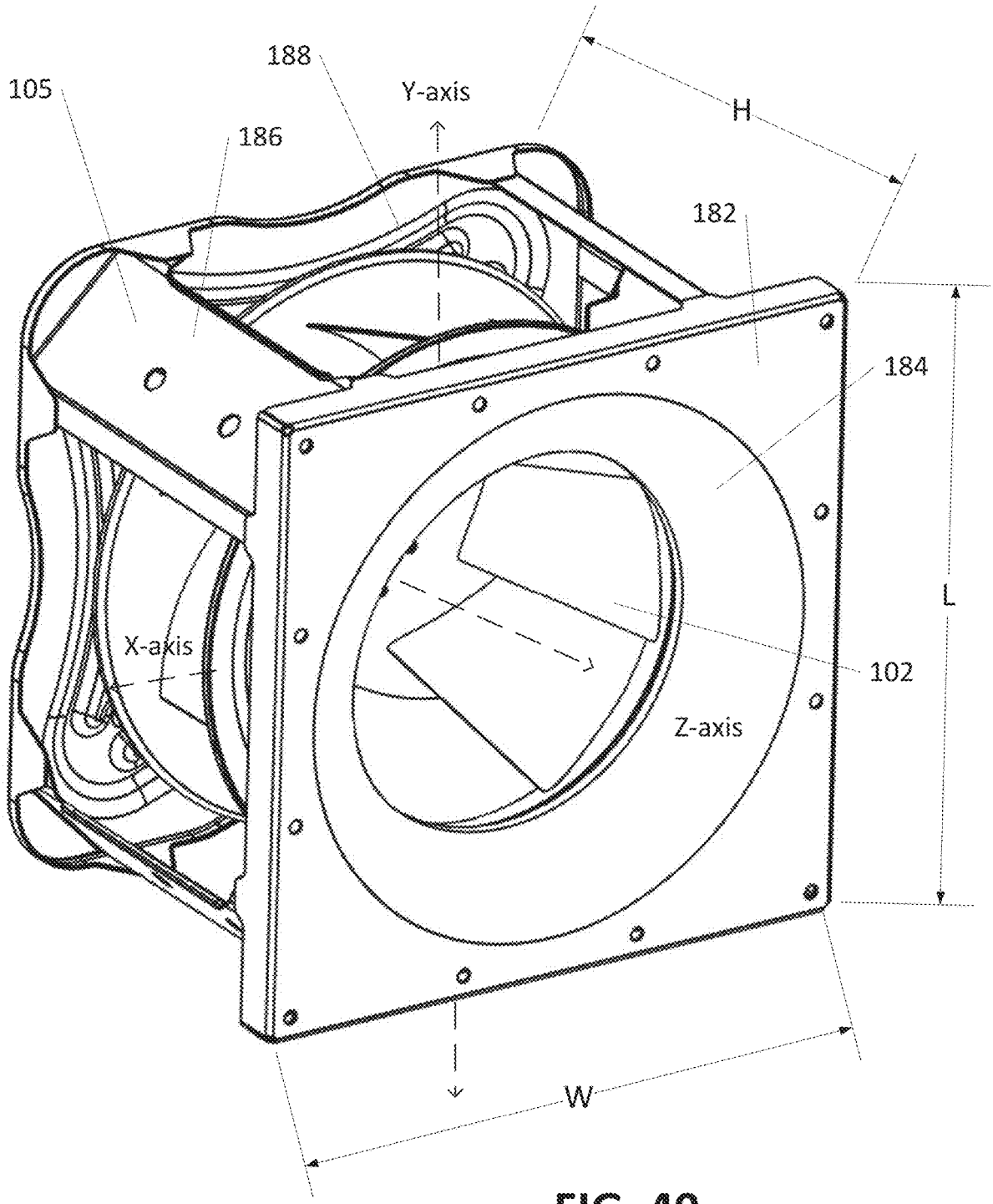
FIG. 40 is a front, perspective view depicting a fan assembly including a frame having one or more shaped struts configured to guide a flow of air exiting a mounted centrifugal fan, in accordance with embodiments of the disclosure.

With additional reference to FIGS. 37-39, in some embodiments, the housing 104 can be replaced with a pseudo-housing or frame 105. In particular, the frame 105 can provide a support for the centrifugal fan 102 via the electric motor 106.

In some embodiments, the frame can include motor a first side 182, for example in the form of a substantially planar wall defining a width (W) and length (L) of the fan assembly 100 along the respective x- and y-axes. The first side 182 can define a central air inlet aperture 184, which can provide an inlet path for air flowing through the centrifugal fan 102. Although the first side 182 is depicted as being substantially square, other shapes and configurations, including those depicted in FIGS. 15, 16 and 19-23, as well as a variety of other geometric shapes are also contemplated.

As further depicted, one or more struts 186 can extend substantially orthogonal to the first side 182 along the z-axis, such that collectively with the first side 182 and a motor mount or second side 188, the one or more struts define a depth or height (H) of the fan assembly 100. In some embodiments, the one or more struts 186 can be configured as lightweight, tubular structures providing a secure mounting platform for the second side 188. As depicted, in some embodiments, the one or more struts 186 can include at least one L-bend 190 and terminate in a coupling bracket 192, which can be operably coupled to the second side 188. In other embodiments, the coupling brackets 192 can be configured to be operably coupled directly to the electric motor 106.

In embodiments, structural aspects of the centrifugal fan 102 and electric motor 106 can be substantially similar to the previously disclosed embodiments, particularly with respect to the use of a high-efficiency fan such as that depicted in FIGS. 7-13 and the positioning of a portion of the electric motor 106 at least partially within an interior region 156 of the centrifugal fan 102, such as that depicted in FIGS. 24-27. Similarly, fan assemblies 100 incorporating a frame 105 can be incorporated into a fan array 200 comprising multiple fan assemblies 100, potentially including different housing 104 and/or frame 105 configurations to reduce or inhibit airflow cross communication between adjacent fan assemblies 100.

Figure 41:
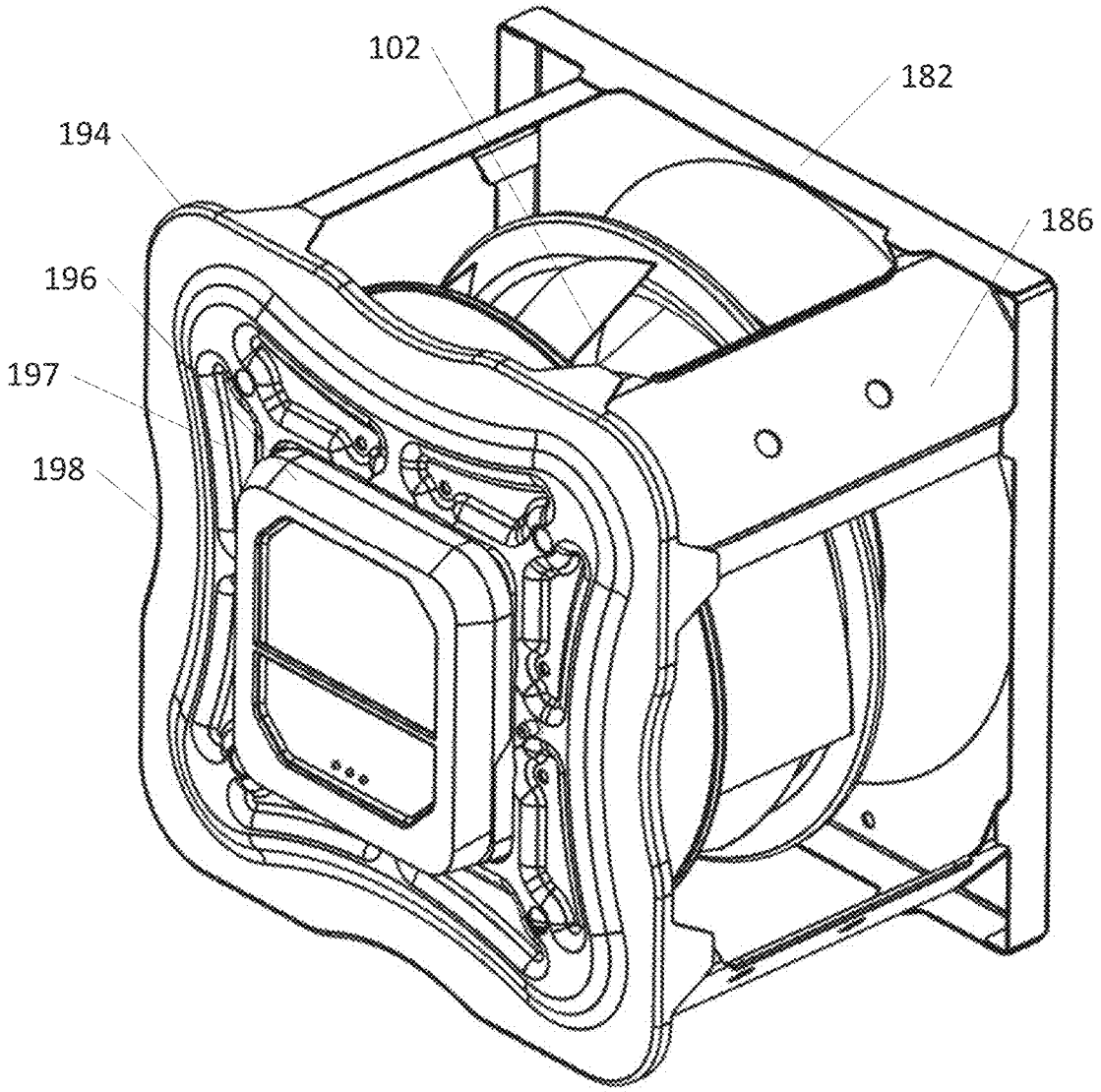
FIG. 41 is a rear perspective view depicting the fan assembly of FIG. 38, in accordance with an embodiment of the disclosure.
Figure 42:
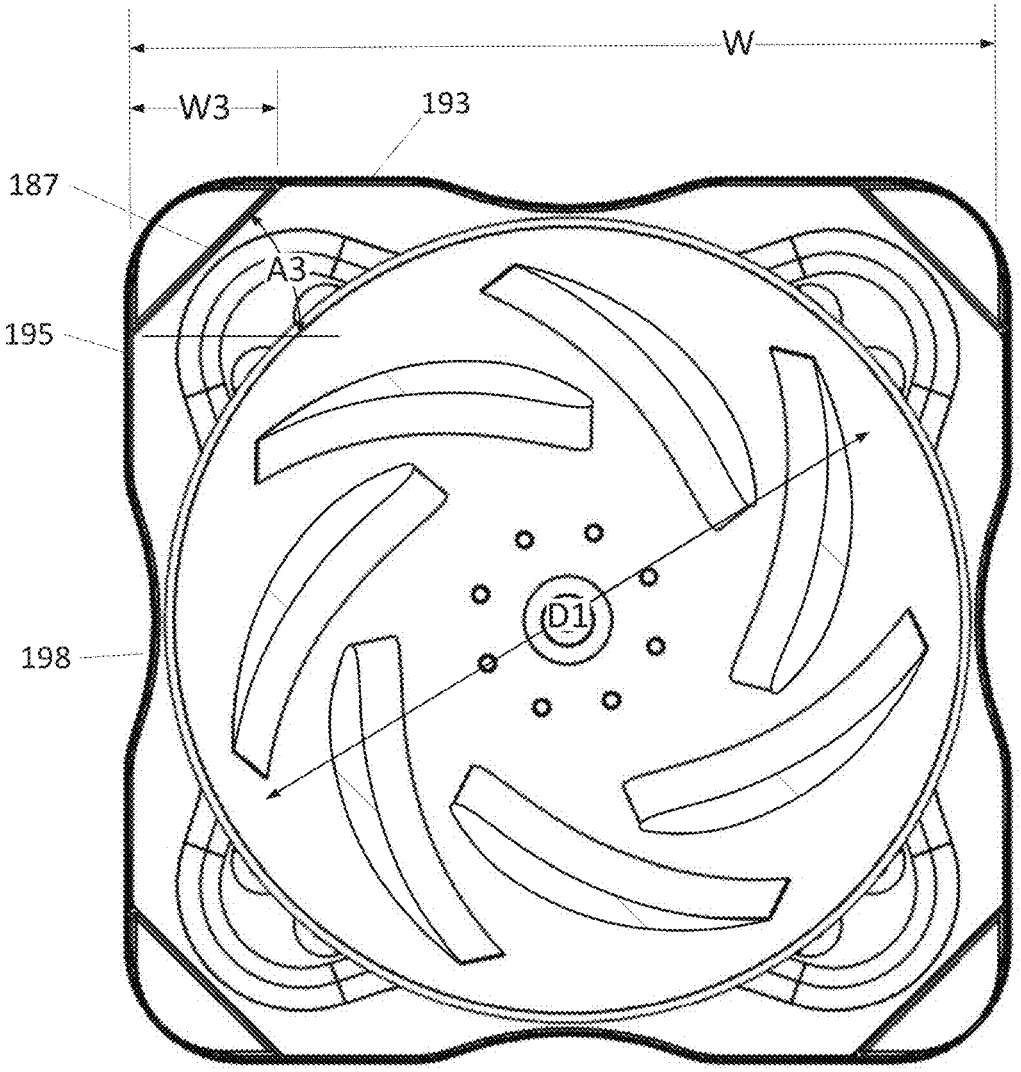
FIG. 42 is a cross-sectional plan view of the fan assembly of FIG. 38, in accordance with an embodiment of the disclosure.

With additional reference to FIGS. 40-43, in some embodiments, the second side 188 can be constructed as a substantially planar surface. For example, as best depicted in FIG. 41, the second side 188 can generally be in the form of a quadrilateral shape, with filleted or chamfered corners 194. In embodiments, the second side 188 can define a motor mount 196 configured to receive and mount a portion of the motor 106. To aid in installation of the fan assemblies 100, in some embodiments, the second side 188 can define one or more structural contours 197 configured decreased bending along the x- and y-axes, as well as one or more material cutouts 198, for example to provide a hand grip surface, which can be particularly useful when the fan assemblies 100 are arranged a fan array 200. As best depicted in FIG. 42, in some embodiments, the material cutouts 198 can generally be defined by an elliptical shape, although other car configurations are also contemplated.

Figure 43:
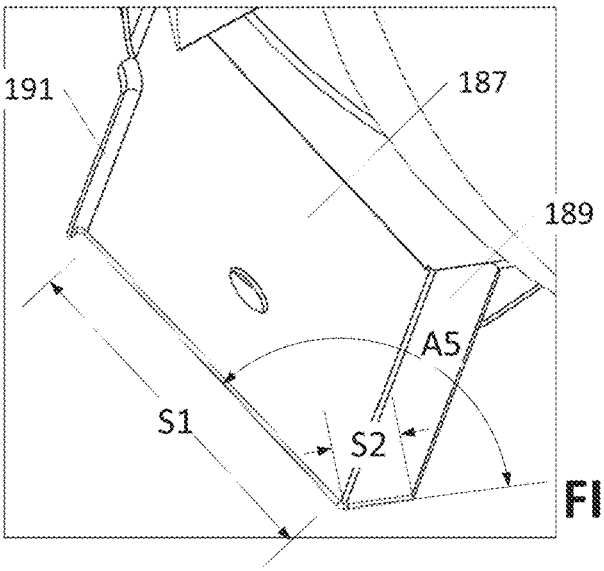
FIG. 43 is a detail, cross-sectional view of a strut of the fan assembly of FIG. 38, in accordance with an embodiment of the disclosure.

As further depicted in FIGS. 40-44, in some embodiments, the one or more struts 186 can be constructed as structural members including multiple planes positioned at oblique angles relative to another. For example, as best depicted in FIG. 43, in some embodiments, each strut 186 can include a primary deflection surface 187, a secondary deflection surface 189, and a structural edge 191, wherein the primary and secondary deflection surfaces 187, 189 generally serve to both provide a structural connection between the first side 182 and the second side 188, as well as generally guide a flow of air exiting the centrifugal fan 102.

In embodiments, the first side 182 can have a first cross-sectional width 51, and the second side can have a second cross-sectional width S2. In some embodiments, first cross-sectional width 51 can be larger than second cross-sectional with S2 by a multiple of at least four. Further, as depicted, in some embodiments, the primary and secondary deflection surfaces 187, 189 can be angled relative to one another at angle A5, which in some embodiments can be in a range of about 100° to about 150°; although other angles are also contemplated. The structural edge 191 can be formed as curled or folded lip along one edge of the strut 186 which can generally serve to increase the structural integrity of the strut 186.

As best depicted in FIG. 42, in some embodiments, the primary deflection surface 187 can be positioned relative to the second side 188 to span between a first edge 193 and a second edge 195, to generally form a chamfered corner, with the secondary deflection surface 189 positioned generally parallel to at least one of the first edge 193 or the second edge 195. With the first cross-sectional width 51 of the strut 186 forming a hypotenuse of a triangle, the other sides of the triangle can extend along the first and second edges 193, 195 up to width W3, which in some embodiments can be less than one fourth of the width W of the fan assembly 100. As further depicted, the primary deflection surface 187 can be positioned at an angle A3 relative to at least one of the x- or y-axes, for example, wherein the angle A3 is in the range of between about 44 degrees and about 20 degrees, which has the effect generally guiding a flow of air exiting the centrifugal fan 102 in a desired direction for improved efficiency.

Figure 44:
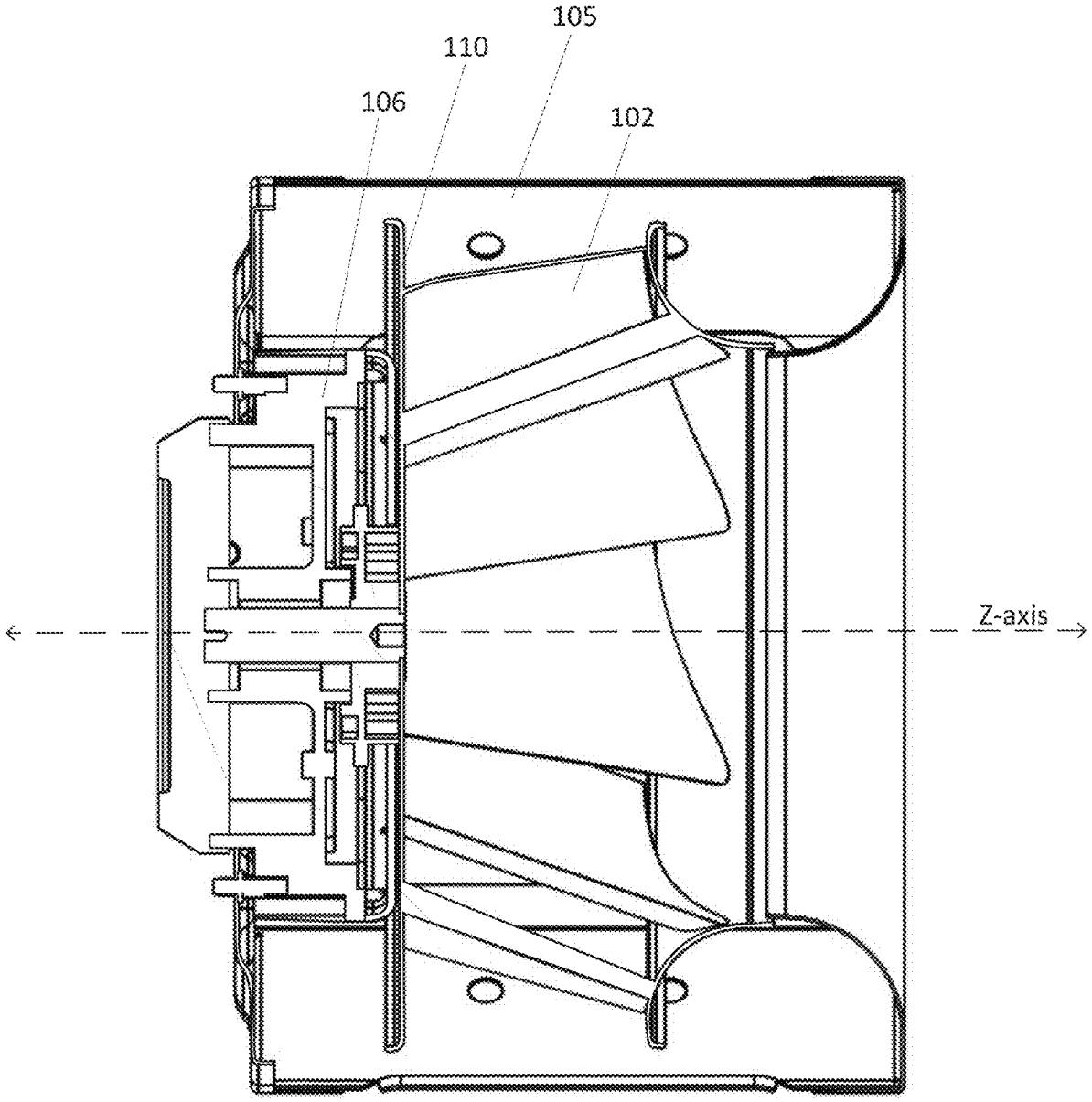
FIG. 44 is a cross-sectional view depicting the fan assembly of FIG. 40, in accordance with an embodiment of the disclosure.

As best depicted in FIG. 44, structural aspects of the centrifugal fan 102 and electric motor 106 can be substantially similar to the previously disclosed embodiments. That is, although centrifugal fan 102 is depicted as having a substantially flat wheel back 110, in other embodiments, the assembly 100 can employ a fan having a contoured wheel back 110 such as that depicted in FIGS. 7-13, wherein a portion of the electric motor 106 is at least partially within an interior region 156 of the centrifugal fan 102, such as that depicted in FIGS. 24-27. Similarly, fan assemblies 100 incorporating a frame 105 can be incorporated into a fan array 200 comprising multiple fan assemblies 100, potentially including different housing 104 and/or frame 105 configurations to reduce or inhibit airflow crosstalk or cross-communication between adjacent fan assemblies 100.

Having described the preferred aspects and implementations of the present disclosure, modifications and equivalents of the disclosed concepts may readily occur to one skilled in the art. However, it is intended that such modifications and equivalents be included within the scope of the claims which are appended hereto.

What is claimed is:

1. A fan assembly, comprising:
a centrifugal fan including a wheel back; and
a housing comprising:
a first end wall defining a central opening;
a second end wall, wherein the second end wall presents an inner and outer surface having a curvature in a direction away from the first end wall towards an outer perimeter of the housing;
a plurality of sidewalls extending between the first and second end walls, each of the plurality of sidewalls defining a main portion and a transition portion deviating radially from the main portion; and
a plurality of openings located adjacent the transition portions and extending at least partially between the first and second end walls,
wherein the inner surface of the second end wall is a continually curved surface extending from the wheel back of the centrifugal fan to the plurality of openings.

2. The fan assembly of claim 1, wherein the plurality of openings includes three to five openings.

3. The fan assembly of claim 2, wherein the plurality of openings includes four openings.

4. The fan assembly of claim 1, wherein the plurality of sidewalls are identical to each other.

5. The fan assembly of claim 1, wherein the transition portions are curved.

6. The fan assembly of claim 5, wherein the transition portions are curved in a concave direction with respect to a longitudinal axis of the housing.

7. The fan assembly of claim 5, wherein the transition portions are curved with a first curved portion and a second curved portion, wherein the first curved portion is curved in a concave direction with respect to a longitudinal axis of the housing and the second curved portion is curved in a convex direction with respect to the longitudinal axis.

8. The fan assembly of claim 1, wherein the plurality of openings are non-coplanar with the main portions of the plurality of the sidewalls.

9. The fan assembly of claim 1, wherein the first end wall and the second end wall each have a curvature oriented axially in a first direction.

10. A fan assembly comprising:
a centrifugal fan wheel including a wheel back; and
a housing defining an interior cavity housing the fan wheel, the housing including:
a first end wall defining a central opening;
a second end wall, wherein the second end wall presents an inner and outer surface having a curvature in a direction away from the first end wall towards an outer perimeter of the housing;
a plurality of sidewalls extending between the first and second end walls, each of the plurality of sidewalls defining a main portion and a transition portion deviating radially from the main portion; and
a plurality of openings located adjacent the transition portions and extending at least partially between the first and second end walls,
wherein the inner surface of the second end wall is a continually curved surface extending from the wheel back of the centrifugal fan to the plurality of openings.

11. The fan assembly of claim 10, wherein the plurality of openings includes three to five openings.

12. The fan assembly of claim 11, wherein the plurality of openings includes four openings.

13. The fan assembly of claim 10, wherein the plurality of sidewalls are identical to each other.

14. The fan assembly of claim 10, wherein the transition portions are curved.

15. The fan assembly of claim 14, wherein the transition portions are curved in a concave direction with respect to a longitudinal axis of the housing.

16. The fan assembly of claim 14, wherein the transition portions are curved with a first curved portion and a second curved portion, wherein the first curved portion is curved in a concave direction with respect to a longitudinal axis of the housing and the second curved portion is curved in a convex direction with respect to the longitudinal axis.

17. The fan assembly of claim 10, wherein the plurality of openings are non-coplanar with the main portions of the plurality of the sidewalls.

18. The fan assembly of claim 10, wherein the first end wall and the second end wall of the housing each have a curvature oriented in a first direction.

19. A fan array comprising:
a plurality of fan assemblies arranged in an array, each of the plurality of fan assemblies including a centrifugal fan wheel including a wheel back and a housing defining an interior cavity housing the centrifugal fan wheel, the housing including:
a first end wall defining a central opening;
a second end wall, wherein the second end wall presents an inner surface having a curvature in a direction away from the first end wall towards an outer perimeter of the housing;

a plurality of sidewalls extending between the first and second end walls, each of the plurality of sidewalls defining a main portion and a transition portion deviating radially from the main portion; and a plurality of openings located adjacent the transition portions and extending at least partially between the first and second end walls, wherein the inner surface of the second end wall is a continually curved surface extending from the wheel back of the centrifugal fan wheel to the plurality of openings.

20. The fan array of claim 19, wherein the fan assemblies are oriented such that, for each opening, a tangent line extending from an outer diameter of the centrifugal fan wheel and through the opening does not intersect with the housing of any other fan assembly in the fan array.

21. The fan array of claim 19, wherein at least some of the fan assemblies are located in an axially offset position relative to other of the plurality of fan assemblies.

22. The fan array of claim 19, wherein the plurality of openings includes three to five openings.

23. The fan array of claim 19, wherein the first end wall of the housing has a curvature in a direction opposite the second end wall and along the longitudinal axis.

24. The fan array of claim 19, wherein the first end wall and the second end wall of the housing each have a curvature oriented in the same direction along the longitudinal axis.

25. The fan array of claim 19, wherein the plurality of fan assemblies include at least two fan assemblies with different housings.

26. The fan array of claim 25, wherein at least one of the different housings includes at least one of a curved first end wall and a curved second end wall.

* * * * *